US005578960A

United States Patent [19]

Matsumura et al.

[11] Patent Number: 5,578,960

[45] Date of Patent: Nov. 26, 1996

[54] DIRECT-CURRENT STABILIZER

[75] Inventors: Tsuneo Matsumura, Shiki-gun; Kenji Hachimura, Nara; Tomohiro Suzuki, Kitakatsuragi-gun, all of Japan

[73] Assignee: Sharp Kabushiki Kaisha, Osaka, Japan

[21] Appl. No.: 527,016

[22] Filed: Sep. 12, 1995

Related U.S. Application Data

[63] Continuation of Ser. No. 76,154, Jun. 14, 1993, abandoned.

[30] Foreign Application Priority Data

Sep. 30, 1992 [JP] Japan ..... 4-262060

[51] Int. Cl.[6] ..... H03K 3/01; G05F 1/40

[52] U.S. Cl. ..... 327/535; 327/538; 327/575; 327/478; 327/540; 327/108; 327/306; 327/560; 323/280; 323/281; 323/276

[58] Field of Search ..... 307/296.8, 296.6, 307/315, 494, 491, 360, 571; 323/280, 281, 266, 276

[56] References Cited

U.S. PATENT DOCUMENTS

| | | | |
|---|---|---|---|
| 3,470,457 | 9/1969 | Howlett | 323/280 |
| 4,008,418 | 2/1977 | Murphy | 323/276 |
| 4,068,136 | 1/1978 | Minami | 302/494 |
| 4,393,346 | 6/1983 | Jones | 323/280 |
| 4,933,572 | 6/1990 | Smith et al. | 307/360 |
| 4,950,975 | 8/1990 | Fleischer | 323/266 |
| 5,079,497 | 1/1992 | Barbu et al. | 323/281 |
| 5,130,635 | 7/1992 | Kase | 307/296.6 |
| 5,182,526 | 1/1993 | Nelson | 323/280 |
| 5,313,381 | 5/1994 | Balakrishnan | 363/147 |
| 5,399,916 | 3/1995 | Fujihira et al. | 327/535 |

FOREIGN PATENT DOCUMENTS

| | | |
|---|---|---|
| 0280514A1 | 8/1988 | European Pat. Off. . |
| 3832963 | 4/1990 | Germany . |
| 4224202 | 2/1993 | Germany . |
| 60-49415 | 3/1985 | Japan . |
| WO88/06757 | 9/1988 | WIPO . |

OTHER PUBLICATIONS

"Floating regulator gives 0.1% regulation over 0–100 Vdc, 200 MA range", Wurzburg, Electronic Design 19, Sep. 13, 1975.

"Regulated on–chip supply voltage source for MOSFET integrated circuits", Concannon et al., IBM Technical Disclosure bulletin, vol. 24 No. 9, Feb. 1982.

IBM Technical Disclosure Bulletin, vol. 24, No. 9, Feb. 1982, pp. 4668–4669, Concannon et al., "Regulated On–Chip Supply Voltage Source For MOSFET Intetrated Circuits".

*Primary Examiner*—Timothy P. Callahan
*Assistant Examiner*—Dinh T. Le
*Attorney, Agent, or Firm*—Nixon & Vanderhye P.C.

[57] ABSTRACT

A direct-current stabilizer includes an n-p-n transistor as a control transistor, and a control terminal to which a control voltage for driving the control transistor is applied. The value of the control voltage is determined so that a voltage applied to the base of the control transistor is not lower than the sum of the emitter voltage and the base-emitter voltage. With this structure, since the control transistor is driven by the control voltage of a value different from that of the input voltage, it is possible to limit the input voltage to a low value, allowing the difference between the input voltage and the output voltage to be minimized. Moreover, it is possible to switch the output of the direct-current stabilizer by connecting to the control terminal a transistor for switching the application of the control voltage to the control terminal between on and off. Furthermore, when the control terminal is connected to the input terminal, the control transistor is driven by the input voltage. Therefore, the direct-current stabilizer is used in the same manner as a conventional direct-current stabilizer is used.

2 Claims, 22 Drawing Sheets

DIRECT-CURRENT STABILIZER

This is a continuation of application Ser. No. 08/076,154, filed Jun. 14, 1993, now abandoned.

FIELD OF THE INVENTION

The present invention relates to a direct-current stabilizer including an n-p-n transistor for controlling an output voltage.

BACKGROUND OF THE INVENTION

In general, a direct-current stabilizer is used to supply a DC voltage necessary for electronic devices. For example, a so-called dropper-type direct-current stabilizer which outputs a stabilized voltage by decreasing an input voltage is commonly used because it has low noise and is easy to design. The following description discusses such direct-current stabilizers.

As illustrated in FIG. 19, in a direct-current stabilizer, for example, when an input voltage applied to an input terminal IN reaches a predetermined level, an actuator 81 starts operating and a reference voltage circuit 82 generates a reference voltage. An output voltage $V_O$ delivered to an output terminal OUT is divided by resistors $R_{81}$ and $R_{82}$. The difference between the resulting voltage and the reference voltage is amplified by a differential amplifier 83.

The differential amplifier 83 controls the base current of a transistor $Tr_{81}$ through a transistor $Tr_{82}$ by adjusting an output according to the difference. The transistor $Tr_{81}$ is an n-p-n transistor for controlling output, and stabilizes the output voltage $V_O$ by controlling the base currents. The output voltage $V_O$ is applied to a load 84. The output characteristics of the output voltage $V_O$ is improved by a capacitor $C_{81}$ connected to the output terminal OUT in parallel with the load 84.

When the collector current of the transistor $Tr_{81}$ is increased by a short circuit or overload, the voltage drop in a resistor $R_{83}$ connected to the emitter of the transistor $Tr_{81}$ becomes significant. Then, the base-emitter voltage of a transistor $Tr_{83}$ for controlling current is significantly increased. This causes the transistor $Tr_{83}$ to be switched on, and the base currents of the transistors $Tr_{82}$ and $Tr_{81}$ to be limited. Consequently, the collector current of the transistor $Tr_{81}$ is limited, and the transistor $Tr_{81}$ is protected from an overcurrent.

Another direct-current stabilizer shown in FIG. 20 includes a p-n-p transistor $Tr_{84}$ for controlling output. Similar to the above-mentioned n-p-n transistor, with the p-n-p transistor $Tr_{84}$, the reference voltage circuit 82 generates a reference voltage with the operation of the actuator 81, an output voltage is divided by the resistors $R_{81}$ and $R_{82}$, and a difference between the divided voltage and the reference voltage is amplified by the differential amplifier 83. The base current of the transistor $Tr_{84}$ is controlled by the output of the differential amplifier 83 through a transistor $Tr_{85}$ as driver, and thereby stabilizing the output voltage $V_O$.

When the collector current of the transistor $Tr_{84}$ is increased by a short circuit or overload, the collector current of the transistor $Tr_{85}$ is also increased. The base-emitter voltage of a transistor $Tr_{86}$ for controlling current is increased by a resistor $R_{84}$ which is connected in series with the emitter of the transistor $Tr_{85}$. This causes the transistor $Tr_{86}$ to be switched on, and the base currents of the transistors $Tr_{85}$ and $Tr_{84}$ to be limited. As a result, the collector Current of the transistor $Tr_{84}$ is limited and the transistor $Tr_{84}$ is protected from an overcurrent.

However, since the former direct-current stabilizer uses the n-p-n transistor $Tr_{81}$ to control the output voltage, the collector-emitter voltage drops significantly, causing considerable losses and poor efficiency.

On the other hand, the latter direct-current stabilizer uses the p-n-p transistor $Tr_{84}$ for controlling the output voltage so as to reduce the losses by minimizing the potential difference between the input voltage and the output voltage. However, such a direct-current stabilizer also has the following problem.

The p-n-p transistor usually can not produce a direct current gain that a n-p-n transistor of the same chip size produces. Therefore, in order to produce a direct current gain similar to the gain of the n-p-n transistor of the same rating, it is necessary to increase the size of the chip, resulting in an increase in costs.

Moreover, the direct-current stabilizer using a p-n-p transistor presents the following structural problem.

A direct-current stabilizer shown in FIG. 21 has a structure where a transistor section 91 as a transistor for controlling an output voltage and an IC section 92 for controlling the transistor are vertically arranged on a single chip. More specifically, such a direct-current stabilizer has a Complicated structure where an n+ buried layer 94 and a $p^+$ buried layer 95 are formed in this order on a p-type substrate 93. In addition, there is a need to provide a p-well region 96 to form the p-n-p structure. Therefore, the number of wafer processes in manufacturing is increased, resulting in an expensive chip. Furthermore, an increase in the number of heat treatment processes causes the diffused layers 97 through 100 to expand, thereby increasing the area and costs of the chip.

A direct-current stabilizer shown in FIG. 22 has a structure where a transistor section 101 as a transistor for controlling output voltage and an IC section 102 for controlling the transistor are laterally arranged on a single chip. In such a direct-current stabilizer, an emitter diffused layer 104, a base diffused layer 105 and a collector diffused layer 106 are formed in a cross direction on an n-type epitaxial layer 103. This arrangement causes the chip to have an increased area, resulting in an increase in costs. The characters (B), (C) and (E) in the drawing represent the base, collector and emitter, respectively.

SUMMARY OF THE INVENTION

An object of the present invention is to provide a direct-current stabilizer which uses an n-p-n transistor as a voltage control element and operates with low losses.

In order to achieve the above object, an integrated direct-current stabilizer of the present invention includes:

an n-p-n control transistor whose base current is controlled in accordance with an output voltage of the direct-current stabilizer, for reducing an input voltage and controlling the output voltage at a predetermined value;

an input terminal for receiving the input voltage; and a first control terminal which is provided separately from the input terminal and connected to the base of the control transistor for supplying to the base of the control transistor a voltage which is not lower than the sum of an emitter voltage and a base-emitter voltage.

In this direct-current stabilizer, when the voltage is applied to the first control terminal, a voltage higher than the sum of the emitters voltage and the base-emitter voltage is applied to the base of the control transistor, thereby turning on the control transistor. Namely, the input voltage is not used for activating the control transistor. Therefore, there is no need to increase the potential difference between the input voltage and the output voltage.

Thus, with the n-p-n control transistor, the losses of the direct-current stabilizer are easily decreased. In addition, since the control transistor is of an n-p-n type, the direct-current stabilizer is manufactured with low costs.

In order to achieve the above object, another integrated direct-current stabilizer of this invention includes:

an n-p-n control transistor for controlling an output voltage of the direct-current stabilizer at a predetermined value by reducing an input voltage;

an input terminal for receiving the input voltage;

a differential amplifier for controlling the base current of the control transistor in accordance with the output voltage so that the control transistor controls the output voltage at a predetermined value; and a second control terminal which is provided separately from the input terminal and connected to the source input of the differential amplifier so as to apply to the base of the control transistor a voltage which is not lower than the sum of the emitter voltage and the base-emitter voltage.

In this direct-current stabilizer, when the voltage is applied to the second control terminal, a voltage higher than the sum of the emitter voltage and the base-emitter voltage is applied to the base of the control transistor by the differential amplifier, and thereby turning on the control transistor. Like the above-mentioned direct-current stabilizer, with this structure, since there is no need to increase the potential difference between the input voltage and the output voltage, a decrease in the losses of the direct-current stabilizer is achieved with low costs.

This direct-current stabilizer further includes an n-p-n or p-n-p transistor which forms a Darlington pair together with the control transistor. The collector of the n-p-n transistor is connected to the second control terminal, while the emitter of the p-n-p transistor is connected to the second control terminal. This structure enables a decrease in the losses of a direct-current stabilizer supplying high output currents.

In order to achieve the above object, still another integrated direct-current stabilizer of this invention includes:

an n-p-n control transistor whose base current is controlled in accordance with an output voltage of the direct-current stabilizer, for reducing an input voltage and controlling the output voltage at a predetermined value;

a driving circuit for driving the control transistor;

an input terminal for receiving the input voltage; and a third control terminal which is provided separately from the input terminal and connected to the source input of the driving circuit so as to apply to the base of the control transistor a voltage which is not lower than the sum of the emitter voltage and the base-emitter voltage.

In this direct-current stabilizer, when the voltage is applied to the third control terminal, a voltage higher than the sum of the emitter voltage and the base-emitter voltage is applied to the base of the control transistor by the driving circuit, thereby turning on the control transistor. Like the above-mentioned direct-current stabilizers, with this structure, since there is no need to increase the potential difference between the input voltage and the output voltage, a decrease in the losses of the direct-current stabilizer is achieved with low costs.

All of the above-mentioned direct-current stabilizers further include a current limiting means for limiting a flow of a current from the first, second and third control terminals. Since the current limiting means limits excessive currents from flowing from the first through third control terminals, the consumption of power is limited.

Moreover, each of the first through third control terminals of these direct-current stabilizers (1) has a withstanding voltage which is higher than that of the input terminal, (2) is connectable to the input terminal, or connectable to the input terminal if, for example, it is placed adjacent to the input terminal, and (3) is connectable to an ON/OFF circuit for starting and stopping an application of voltage.

The direct-current stabilizer having such characteristics brings the following advantages (A) through (D).

(A) Since the withstanding voltage of the control terminal is higher than that of the input terminal, it is possible to apply a voltage higher than the input voltage to the control terminal without increasing the withstanding voltages of other terminals including the input and output terminals which require a change according to the input voltage. Namely, the control transistor is driven by a voltage having a value different from that of the input voltage.

(B) The input voltage is used for driving the control transistor by connecting the control terminal to the input terminal. Since such a direct-current stabilizer functions in the same manner as a convention direct-current stabilizer using an n-p-n transistor, is used for various purposes.

(C) The control terminal and the input terminal are easily connected to each other by placing the control terminal adjacent to the input terminal.

(D) The output of these direct-current stabilizer is externally switched between on and off by controlling the application of voltage to the control terminal by means of the ON/OFF circuit.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a side view showing an internal structure of the regulator IC of FIG. 1.

FIG. 18(*b*) is a side view showing an internal structure of the regulator IC of FIG. 17.

DESCRIPTION OF THE EMBODIMENTS

[EMBODIMENT 1]

The following description discusses a first embodiment of the present invention with reference to FIGS. 1 through 6.

Figure 2:
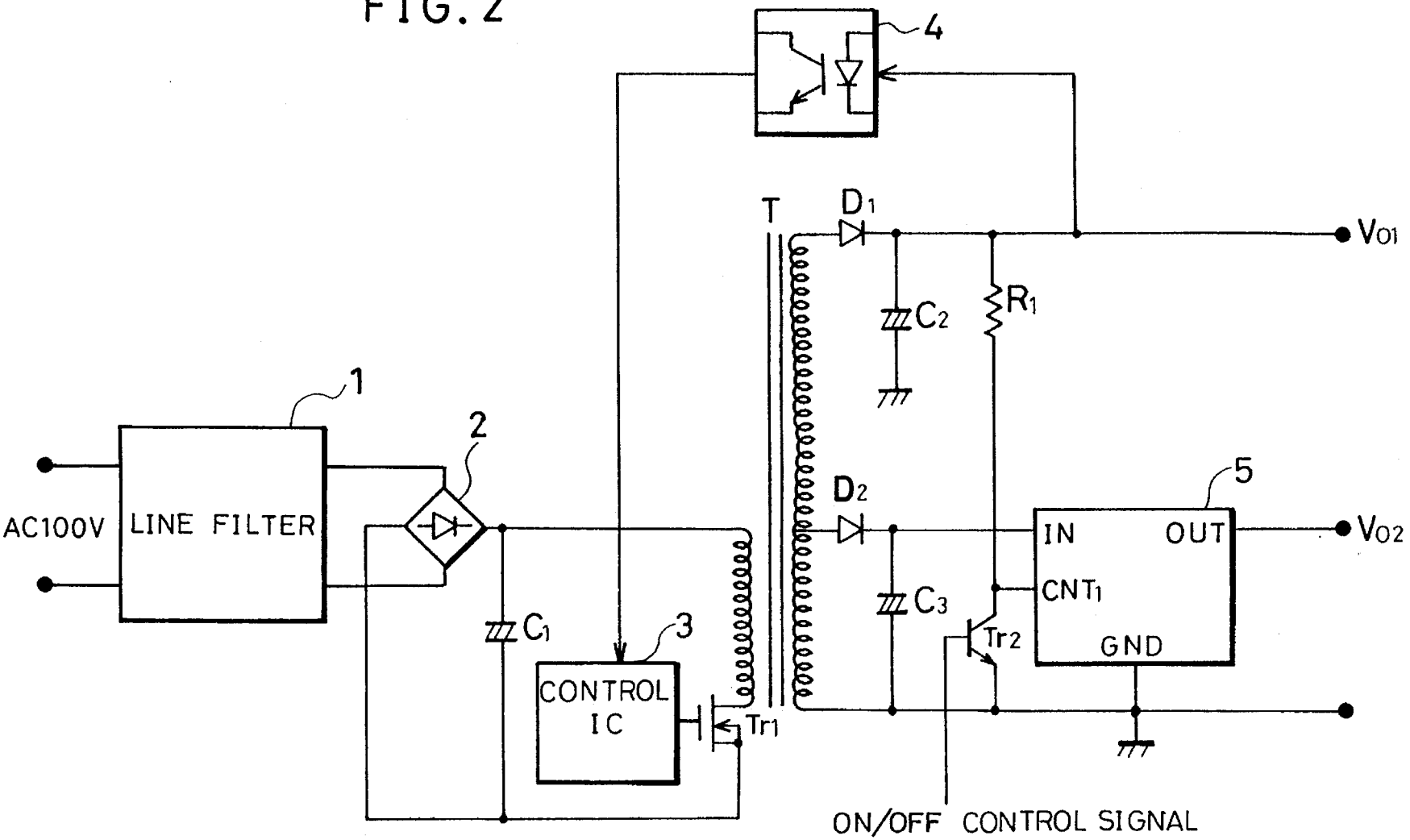
FIG. 2 is a circuit diagram showing a structure of a power source system incorporating the regulator IC of FIG. 1.

As illustrated in FIG. 2, a power source system of this embodiment includes a line filter 1, a bridge rectifier 2, a control IC 3 for controlling switching, a photocoupler 4 for insulation, and a regulator IC 5 as a direct-current stabilizer. The power source system also has a transistor $Tr_1$ for switching, a high frequency transformer T, a transistor $Tr_2$ for controlling ON/OFF switching, smoothing capacitors $C_1$ to $C_3$, diodes $D_1$ and $D_2$ as rectifiers, and a resistor $R_1$.

In this power source system, line noise is removed from a 100 V alternating current by the line filter, and the resulting alternating current is rectified and smoothed by the bridge rectifier 2 and the capacitor $C_1$ to produce a DC voltage. The DC voltage is changed into pulse form when the transistor $Tr_1$ is switched between on and off by the control IC 3. The voltage pulses thus obtained are transmitted through the high frequency transformer T toward the outputs, and rectified and smoothed by a circuit formed by a diode $D_1$ and a capacitor $C_2$ and a circuit formed by a diode $D_2$ and a capacitor $C_3$, respectively, to produce two DC voltages.

The DC voltage output from the diode $D_1$ is fed back as an output voltage $V_{O_1}$ through the photocoupler 4 to the control IC 3. The output voltage $V_{O_1}$ also goes through the resistor $R_1$ and is input to a control terminal $CNT_1$ of the regulator IC 5. On the other hand, the DC voltage output from the diode $D_2$ is input to the input terminal IN of the regulator IC 5.

In the regulator IC 5, an input voltage supplied to the input terminal IN from the diode $D_2$ is controlled by driving a transistor $Tr_3$, to be described later (see FIG. 1), with the output voltage $V_{O_1}$, and a stabilized output voltage $V_{O_2}$ is produced. The output of the regulator IC 5 is switched between on and off by starting or stopping application of voltage to the transistor $Tr_3$. The application of the voltage is started or stopped by switching the transistor $Tr_2$ as an ON/OFF circuit between on and off in accordance with an ON/OFF control signal supplied from an external source.

Figure 1:
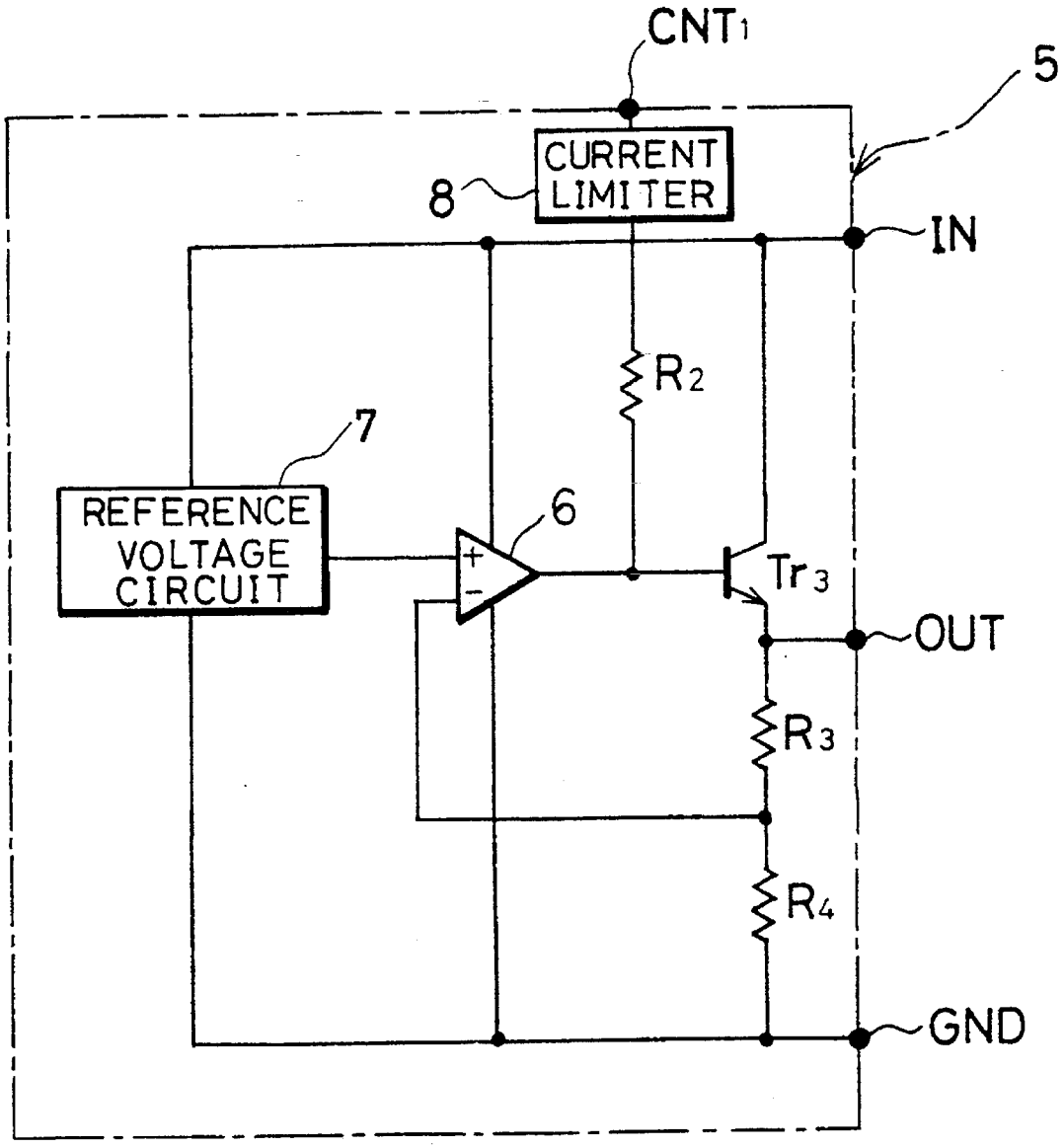
FIG. 1 is a circuit diagram schematically showing a structure of a regulator IC according to a first embodiment of the present invention.

As illustrated in FIG. 1, the regulator IC 5 includes the input terminal IN connected to an external device, an output terminal OUT, a ground terminal GND, and the control terminal $CNT_1$. The regulator IC 5 also includes the transistor $Tr_3$, resistors $R_2$ through $R_4$, a differential amplifier 6 and a reference voltage circuit 7 as essential components for the direct-current stabilizer.

The base of the transistor $Tr_3$ as an n-p-n control transistor is connected to the output terminal of the differential amplifier 6, and connected through the resistor $R_2$ to the control terminal $CNT_1$ as a first control terminal. The collector of the transistor $Tr_3$ is connected to the input terminal IN, while the emitter thereof is connected to the output terminal OUT. The withstanding voltage of the control terminal $CNT_1$ is higher than those of other terminals IN, OUT and GND. Therefore, for example, the control terminal $CNT_1$ has an insulating layer with a thickness greater than those of the insulating layers on other terminals, IN, OUT and GND.

Placed between the output terminal OUT and the ground terminal GND are the resistors $R_3$ and $R_4$ which are connected in series and form a voltage divider. The junction between the resistor $R_3$ and $R_4$ is connected to the negative input of the differential amplifier 6.

The reference voltage circuit 7 is placed between the input terminal IN and the ground terminal GND. The reference voltage circuit 7 is a circuit for generating a predetermined reference voltage according to the input voltage. For example, a fixed voltage element such as a Zener diode, and a fixed voltage circuit are used as the reference voltage circuit 7. The reference voltage circuit 7 is connected to the positive input of the differential amplifier 6 and supplies a predetermined voltage thereto.

The positive source input of the differential amplifier 6 is connected to the input terminal IN, while the negative source input thereof is connected to the ground terminal GND. The differential amplifier 6 controls the emitter voltage or the output voltage of the regulator IC 5 by controlling the base current of the transistor $Tr_3$, so that the feedback voltage divided by the resistors $R_3$ and $R_4$ becomes equal to the reference voltage of the reference voltage circuit 7.

In the regulator IC 5, a current limiter 8 as current limiting means is placed between the control terminal $CNT_1$ and the resistor $R_2$. The current limiter 8 limits an increase in the power consumption by limiting the current flowing from the control terminal $CNT_1$ to the base of the transistor $Tr_3$ to a predetermined value.

Figure 3:
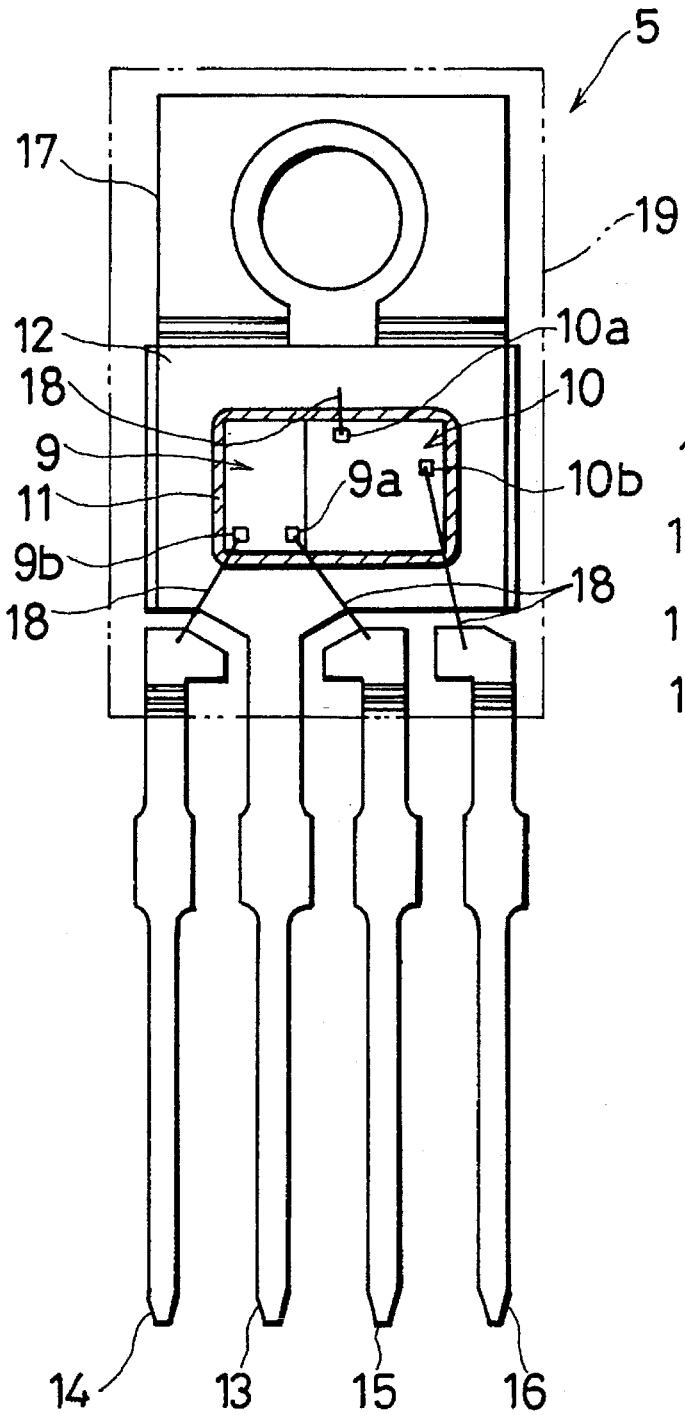
FIG. 3(*a*) is a front view showing an internal structure of the regulator IC of FIG. 1.
Figure 3:
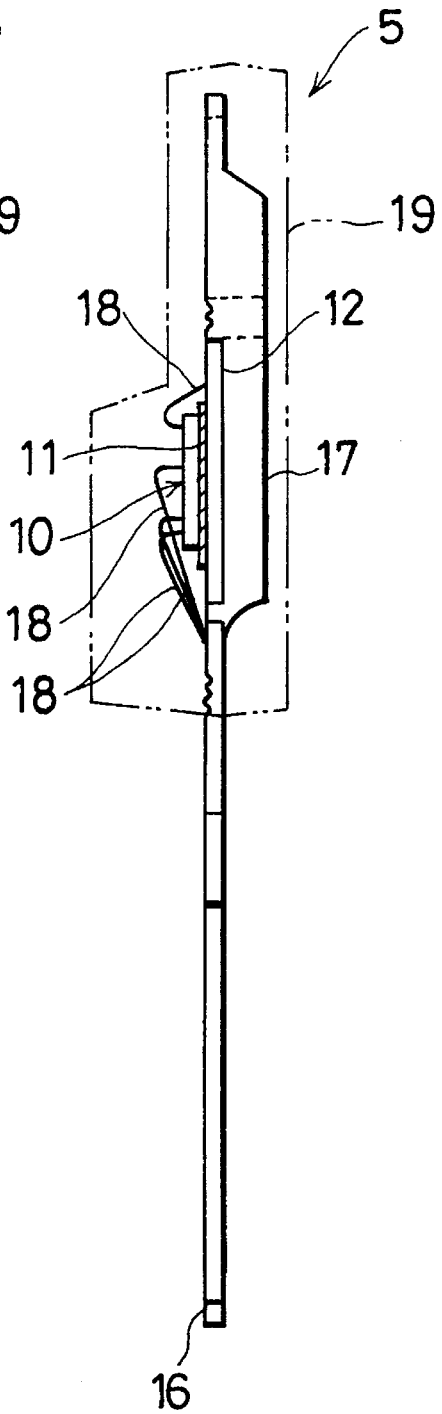

The regulator IC 5 with such a circuit structure includes a transistor section 9 and an IC section 10 manufactured as a single chip as shown in FIGS. 3(*a*) and 3(*b*). The transistor section 9 is the transistor $Tr_3$ produced in chip form. The IC section 10 is formed by integrating on a single chip all the above-mentioned elements and circuits, except for the transistor $Tr_3$. The transistor section 9 and the IC section 10 are die-bonded onto a multi-lead metal frame 12 at a junction 11 of a solder.

A near central portion of one edge of the metal frame 12 is elongated to form an outer lead flame 13 as the ground terminal GND. In FIGS. 3(*a*) and 3(*b*), an outer lead frame 14 as the output terminal OUT is formed in parallel with and on the left side of the outer lead frame 13, while an outer lead frame 15 as the input terminal IN and an outer lead frame 16 as the control terminal $CNT_1$ are formed in parallel with and on the right side of the outer lead frame 13. The metal flame 12 is fixed to an inner lead flame 17.

A contact section 9*a* of the transistor section 9, which functions as a collector, is connected to the outer lead frame 15, and a contact section 9*b* thereof functioning as an emitter is connected to the outer lead frame 14. A contact section 10a of the IC section 10 to be grounded is connected to the metal frame 12, and a contact section 10*b* thereof to which a control signal is input is connected to the outer lead frame 16. These connections are made by wire bonds using metal wires 18.

The chips 9 and 10, the metal flame 12 and the inner lead frame 17 as well as one end of each of the outer lead frames 13 through 16 are covered with a package 19. The package 19 is made from a coating resin, such as an epoxy resin, and formed by transfer-molding for example.

The sectional structure of the transistor section 9 and the IC section 10 is discussed below.

Figure 4:
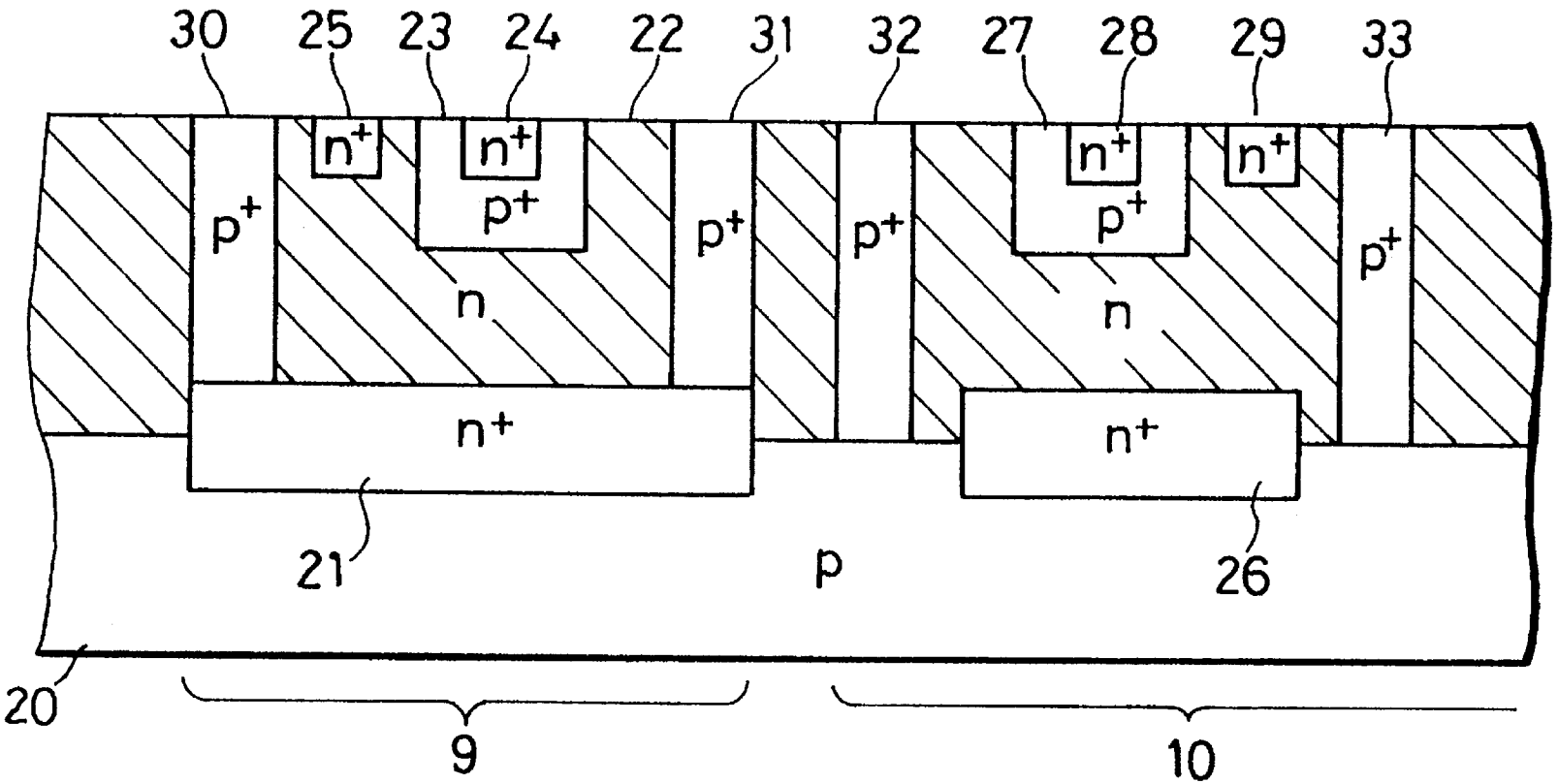
FIG. 4 is a vertical section showing part of a structure of a transistor chip and an IC chip in the regulator IC of FIG. 3.

As illustrated in FIG. 4, in the transistor section 9, an n+ buried layer 21 and an n-type epitaxial layer 22 as the collector are formed on a p-type substrate 20. Further, a base diffused layer 23, an emitter diffused layer 24 and a collector layer 25 are formed on the epitaxial layer 22.

The IC section 10 has a portion where a base diffused layer 27, an emitter diffused layer 28 and a collector layer 29 are formed on an n+ buried layer 26 and the n-type epitaxial layer 22 over the p-type substrate 20. The epitaxial layer 22 includes isolation diffused layers 30 through 33 so as to separate the transistor section 9 and the IC section 10 from each other.

The operation of the regulator IC 5 of such a structure is discussed below.

Figure 5:
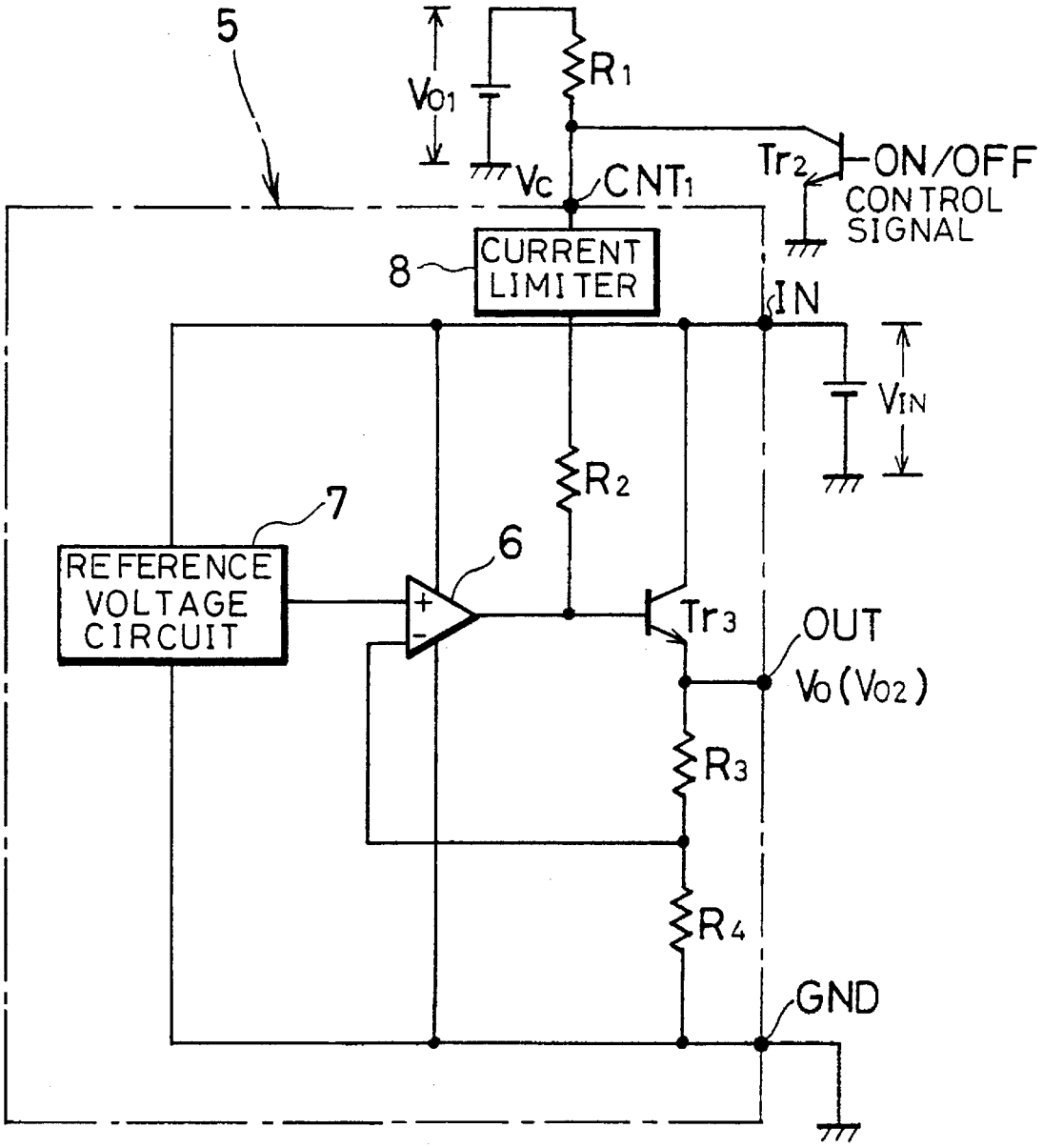
FIG. 5 is a circuit diagram showing a structure of switching the output of the regulator IC of FIG. 1.

As illustrated in FIGS. 2 and 5, a control voltage $V_C$ derived from an output voltage $V_{O_1}$ is applied through the resistor $R_1$ to the control terminal $CNT_1$. When the transistor $Tr_2$ is switched off, the control voltage $V_C$ is applied to the control terminal $CNT_1$. On the other hand, when the transistor $Tr_2$ is switched on, no control voltage $V_C$ is applied to the control terminal $CNT_1$.

The value of the control voltage $V_C$ is set so that a voltage, which is not lower than the sum of the emitter voltage of the transistor $Tr_3$, i.e., the output voltage $V_O$ ($V_{O_2}$) of the regulator IC 5 and the base-emitter voltage, is applied to the base of the transistor $Tr_3$. In the case when the output voltage $V_O$ of the regulator IC 5 is 5 volts, the control voltage $V_C$ is set to a value which meets the requirement, for example, around 10 volts.

When the transistor $Tr_2$ is switched off and the control voltage $V_C$ is applied to the control terminal $CNT_1$, the transistor $Tr_3$ is biased and switched on. At this time, the output voltage $V_O$ appearing at the emitter is divided by the resistors $R_3$ and $R_4$ to produce a feed back voltage. The feed back voltage is applied to the differential amplifier 6, and the reference voltage generated by the reference voltage circuit 7 is also applied thereto. The differential amplifier 6 controls the base current of the transistor $Tr_3$ according to the difference between the feedback voltage and the reference voltage. Thus, the transistor $Tr_1$ controls an input voltage $V_{IN}$ so as to produce the output voltage $V_O$ of a value which is determined by the dividing rate of the resistors $R_3$ and $R_4$ and by the reference voltage.

When the transistor $Tr_2$ is switched on by an ON/OFF control signal, no control voltage $V_C$ is applied to the control terminal $CNT_1$, thereby switching off the transistor $Tr_3$. This causes the output of the regulator IC 5 to be switched off. Namely, the output of the regulator IC 5 is switched between on and off by switching the transistor $Tr_2$ between on and off.

As described above, in the regulator IC 5, the transistor $Tr_3$ is activated upon the application of the control voltage of a predetermined value to the control terminal $CNT_1$. Unlike a regulator IC which uses the input voltage $V_{IN}$ to drive the transistor $Tr_3$, the regulator IC 5 does not require a high input voltage $V_{IN}$. For example, when the output voltage $V_O$ is 5 volt, the input voltage $V_{IN}$ is set to around 5.5 volt in anticipation of a lowering of the collector-emitter voltage of the transistor $Tr_3$.

It is therefore possible to reduce the losses of the regulator IC 5 to a large degree. Moreover, since the n-p-n transistor $Tr_3$ which has a smaller chip size and is inexpensive to manufacture is used, the low-cost regulator IC 5 is obtained.

Furthermore, since the regulator IC 5 includes the current limiter 8 for limiting a current delivered from the control terminal $CNT_1$, it is possible to restrict the power consumption of the regulator IC 5.

Since the withstanding voltage of the control terminal $CNT_1$ is higher than those of other terminals IN, OUT and GND, the regulator IC 5 is protected from the control voltage $V_C$. In addition, it is possible to switch the output of the regulator IC 5 between on and off by connecting the transistor $Tr_2$ to the control terminal $CNT_1$.

Figure 6:
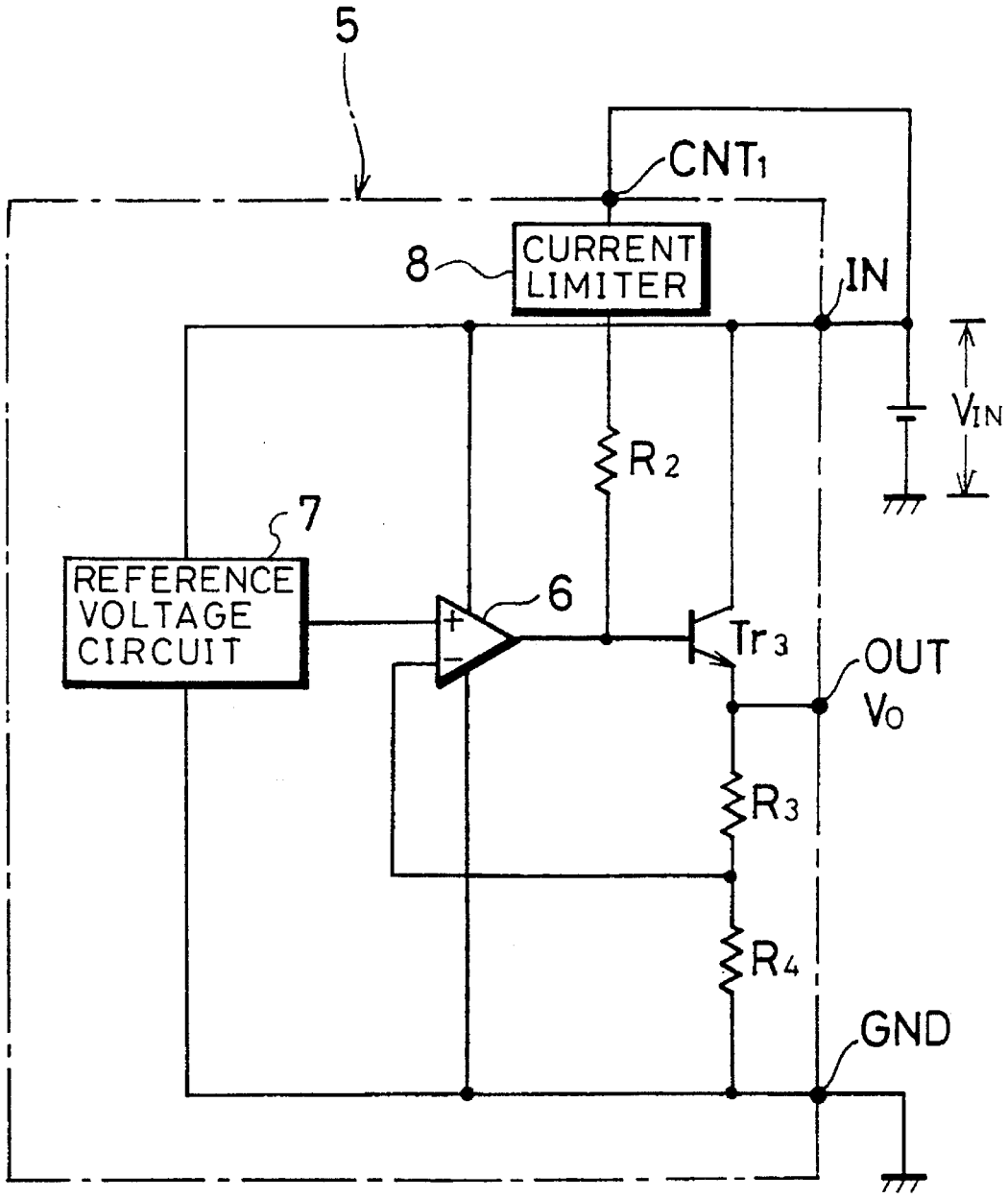
FIG. 6 is a circuit diagram showing a structure of the regulator IC of FIG. 1, wherein a control terminal and an input terminal are connected.

In the regulator IC 5 since the input terminal IN and the control terminal $CNT_1$ are located adjacent to each other as shown in FIG. 3, the input terminal IN and the control terminal $CNT_1$ are easily connected as shown in FIG. 6. With this arrangement, since the input voltage $V_{IN}$ is applied to the control terminal $CNT_1$, the transistor $Tr_3$ is driven by the input voltage $V_{IN}$ like in a conventional regulator IC. Namely, the regulator IC 5 is used even in a power source system with a single output.

Consequently, by providing the control terminal $CNT_1$, the low-cost general-purpose regulator IC 5 achieving a reduction in the losses is obtained.

[EMBODIMENT 2]

Figure 7:
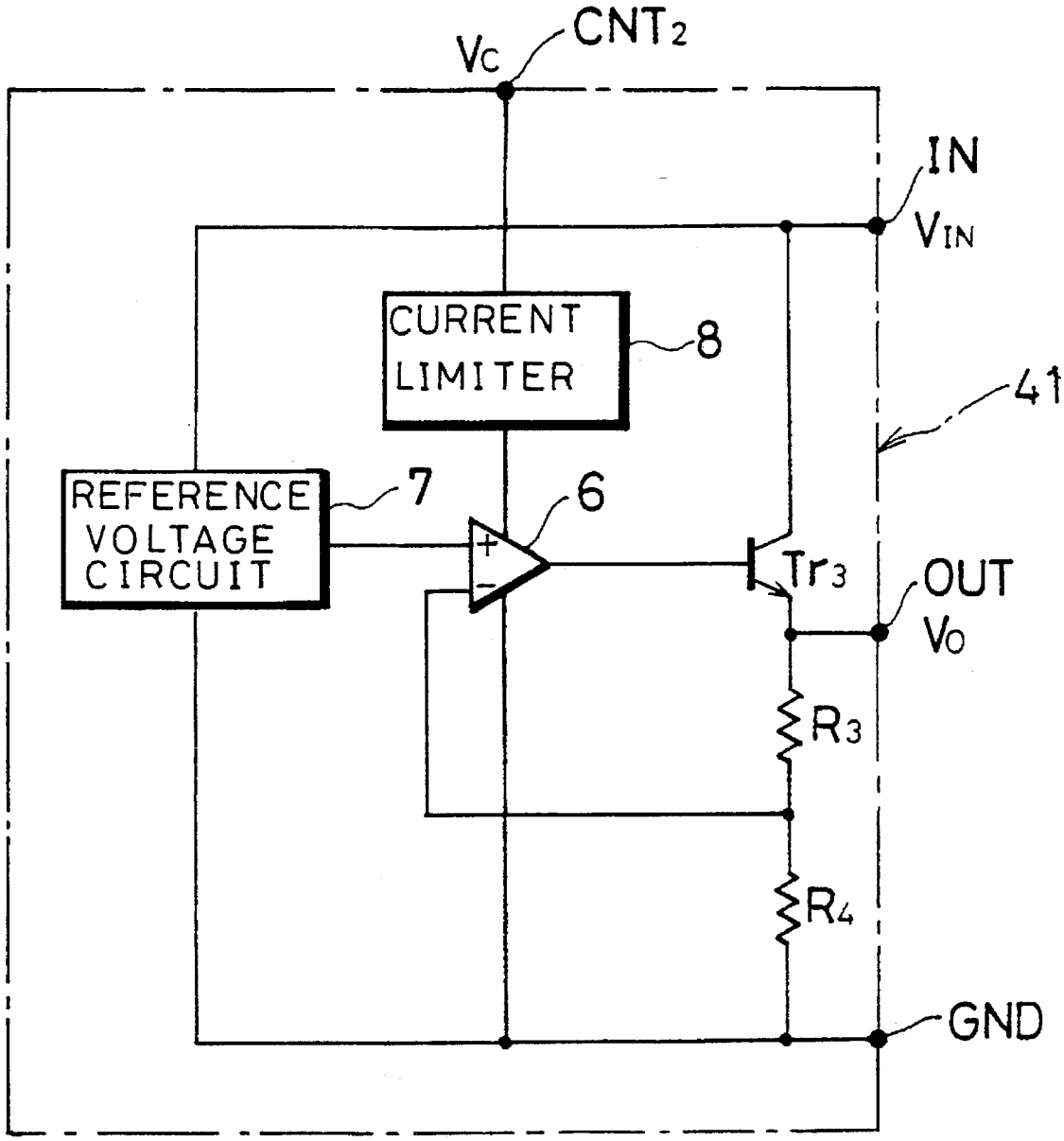
FIG. 7 is a circuit diagram schematically showing a structure of a regulator IC according to a second embodiment of the present invention.
Figure 8:
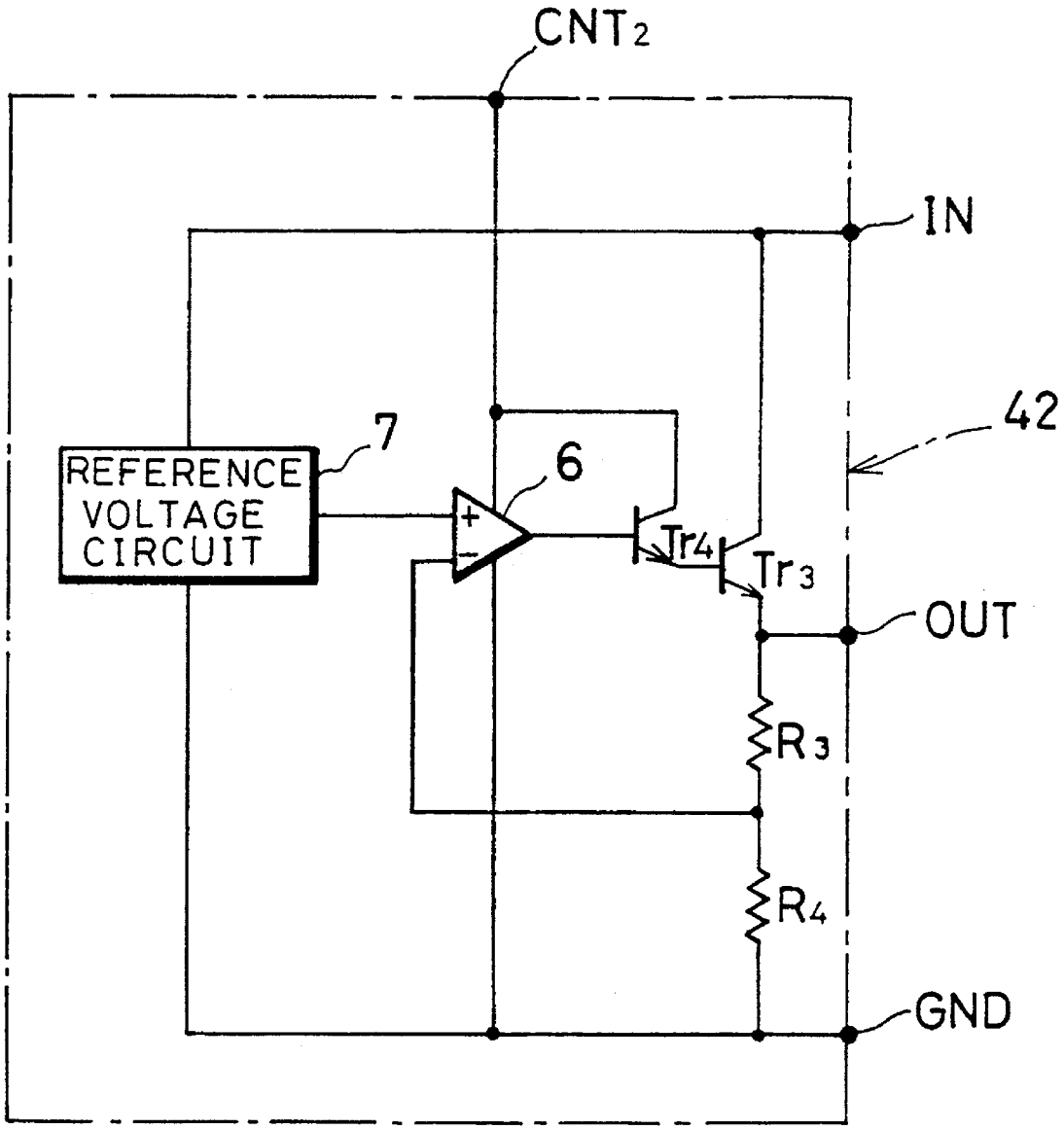
FIG. 8 is a circuit diagram of a modified example of the regulator IC of FIG. 7, having a Darlington pair of an n-p-n transistor and a control transistor.
Figure 9:
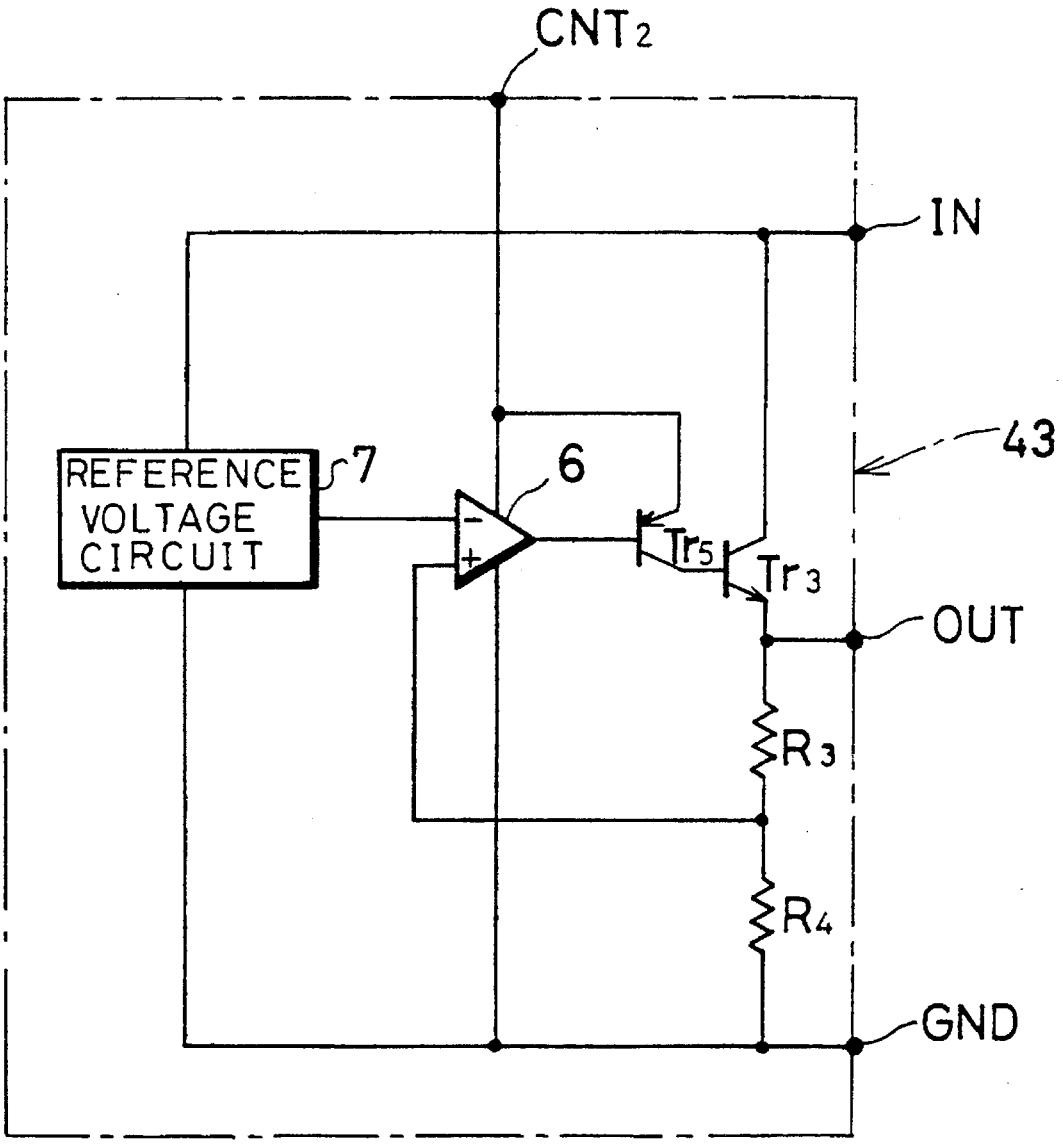
FIG. 9 is a circuit diagram of a modified example of the regulator IC of FIG. 7, having Darlington pair of a p-n-p transistor and a control transistor.

The following description discusses a second embodiment of the present invention with reference to FIGS. 7 through 9. The components having the same function as the components described in the first embodiment will be designated by the same code and their description will be omitted.

A direct-current stabilizer of this embodiment is shown in FIG. 7 as a regulator IC 41 having a control terminal $CNT_2$.

The withstanding voltage of the control terminal $CNT_2$ as a second control terminal is higher than those of other terminals IN, OUT, and GND. The control terminal $CNT_2$ is connected through the current limiter 8 to the positive source input of the differential amplifier 6. The control terminal $CNT_2$ is connectable to a transistor, not shown, like the transistor $Tr_2$ in the first embodiment (see FIG. 5). Connecting the control terminal $CNT_2$ to the transistor allows the output of the regulator IC 41 to be switched between on and off. In an actual IC package, the control terminal $CNT_2$ is located adjacent to the input terminal IN.

The operation of the regulator IC 41 having such a structure is discussed below.

In the regulator IC 41, the control voltage $V_C$ is applied to the control terminal $CNT_2$. The effective variations in the output voltage of the differential amplifier 6 are determined by the power source voltage, i.e., the control voltage $V_C$. Namely, the value of the control voltage $V_C$ is set such that the differential amplifier 6 applies to the base of the transistor $Tr_3$ a voltage not lower than the sum of the emitter voltage and the base-emitter voltage.

When the control voltage $V_C$ is applied to the control terminal $CNT_2$, the transistor $Tr_3$ is biased and switched on, so that the output voltage $V_O$ is delivered to the output terminal OUT. Then, the base current of the transistor $Tr_3$ is controlled by the differential amplifier 6 according to the feedback voltage produced by dividing the output voltage $V_O$ with the resistors $R_3$ and $R_4$ and the reference voltage of the reference voltage circuit 7. Consequently, the transistor $Tr_3$ controls the input voltage $V_{IN}$ to produce the output voltage $V_O$ of a constant value which is determined by the dividing rate of the resistors $R_3$ and $R_4$ and the reference voltage.

As described above, in this embodiment, since the control voltage $V_C$ of value different from that of the input voltage $V_{IN}$ is used as a power source for the differential amplifier 6, the low-cost regulator IC 41 having reduced losses like the above-mentioned regulator IC 5 is obtained.

Modified examples of the regulator IC 41 are shown as regulators IC 42 and 43 in FIGS. 8 and 9.

The regulator IC 42 includes an n-p-n transistor $Tr_4$. The emitter of the transistor $Tr_4$ is connected to the base of the transistor $Tr_3$, forming a Darlington pair. The collector of the transistor $Tr_4$ is connected to the control terminal $CNT_2$ and the base thereof is connected to the output terminal of the differential amplifier 6.

Since the transistors $Tr_3$ and $Tr_4$ of the regulator IC 42 form a Darlington pair, the regulator IC 42 is capable of supplying an output current greater than that of the regulator IC 41. However, the voltage necessary for driving the transistor $Tr_3$ includes the base-emitter voltage of the transistor $Tr_4$. Therefore, the base-emitter voltage must be considered when determining the value of the control voltage $V_C$.

On the other hand, the regulator IC 43 includes a p-n-p transistor $Tr_5$ instead of the transistor $Tr_4$. The transistors $Tr_3$ and $Tr_5$ form a Darlington pair. Since the transistor $Tr_5$ is a p-n-p transistor, the regulator IC 43 is designed so that the differential amplifier 6 draws a current from the base of the transistor $Tr_5$. Namely, the positive input of the differential amplifier 6 is connected to the junction of the resistors $R_3$ and $R_4$, and the negative input is connected to the output of the reference voltage circuit 7. Like the regulator IC 42, the regulator IC 43 with such a structure is capable of supplying high output currents.

[EMBODIMENT 3]

The following description discusses a third embodiment of the present invention with reference to FIGS. 10 through 16. The components having the same function as the components described in the first embodiment will be designated by the same code and their description will be omitted.

Figure 10:
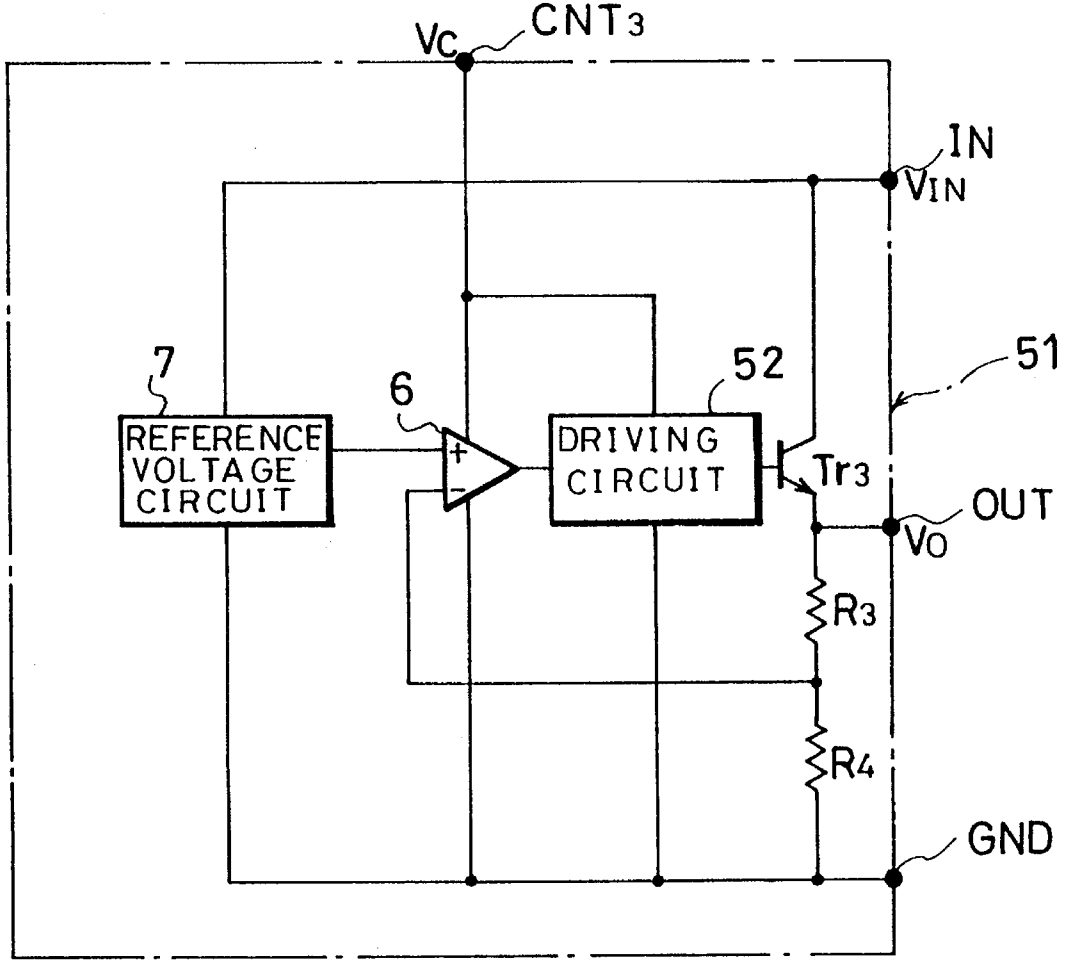
FIG. 10 is a circuit diagram schematically showing a structure of a regulator IC according to a third embodiment of the present invention.

A direct-current stabilizer of this embodiment includes a regulator IC 51 shown in FIG. 10. The regulator IC 51 has a control terminal $CNT_3$ and a driving circuit 52.

The withstanding voltage of the control terminal $CNT_3$ as a third control terminal is higher than those of other terminals IN, OUT, and GND. The control terminal $CNT_3$ is connected to the positive source input of the differential amplifier 6 and the source input of the driving circuit 52. The control terminal $CNT_3$ is connectable to a transistor, not shown, like the transistor $Tr_2$ in the first embodiment (see FIG. 5). Connecting the control terminal $CNT_3$ to the transistor allows the output of the regulator IC 51 to be switched between on and off. In an actual IC package, the control terminal $CNT_3$ is located adjacent to the input terminal IN.

The driving circuit 52 is a circuit including an active element which is activated by the control voltage $V_C$ applied to the control terminal $CNT_3$, and drives the transistor $Tr_3$ under the control of the differential amplifier 6.

The operation of the regulator IC 51 having such a structure is discussed below.

In the regulator IC 51, the control voltage $V_C$ is applied to the control terminal $CNT_3$. The value of the control voltage $V_C$ is set such that the driving circuit 52 applies to the base of the transistor $Tr_3$ a voltage which is not lower than the sum of the emitter voltage and the base-emitter voltage.

When the control voltage $V_C$ is applied to the control terminal $CNT_3$, the transistor $Tr_3$ is biased and switched on, so that the output voltage $V_O$ is delivered to the output terminal OUT. Then, the base current which is supplied from the driving circuit 52 to the transistor $Tr_3$ is controlled by the differential amplifier 6 according to the feedback voltage produced from the output voltage $V_O$ and a reference voltage. Consequently, the transistor $Tr_3$ controls the input voltage $V_{IN}$ to produce the output voltage $V_O$ of a constant value which is determined by the dividing rate of the resistors $R_3$ and $R_4$ and the reference voltage.

As described above, in this embodiment, since the control voltage $v_C$ of a value different from that of the input voltage $V_{IN}$ is used as a power source for the driving circuit 52, the low-cost regulator IC 51 having reduced losses like the regulator IC 5 is obtained.

An application of the regulator IC 51 to a practical circuit is described below.

Figure 11:
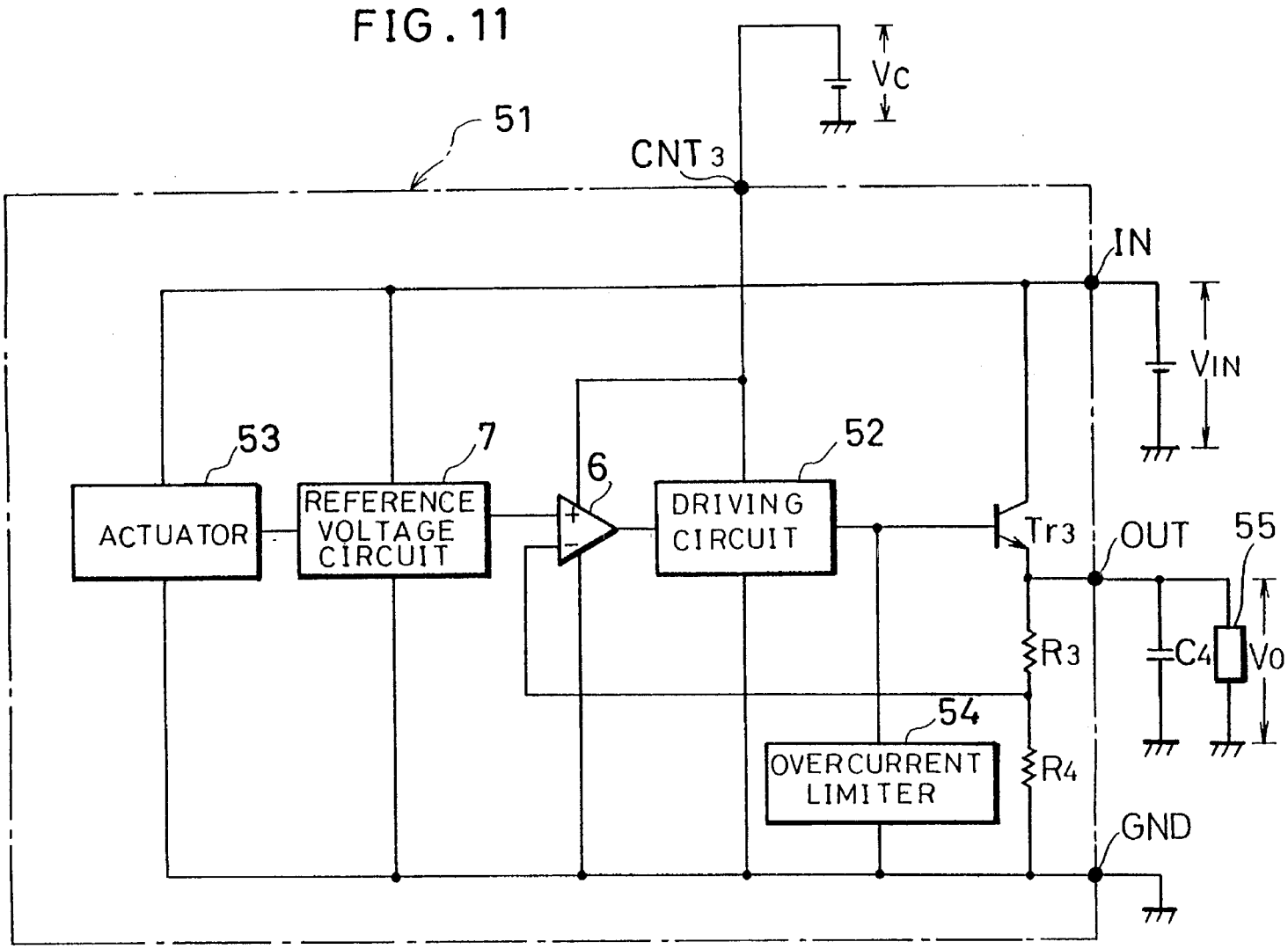
FIG. 11 is a circuit diagram showing the actuation of the regulator IC of FIG. 10 with a control voltage as an example.

As illustrated in FIG. 11, the regulator IC 51 includes an actuator 53 and an overcurrent limiter 54 which are not shown in FIG. 10. The actuator 53 activates the reference voltage circuit 7 when the input voltage $V_{IN}$ reaches a predetermined value. The overcurrent limiter 54 limits the collector current of the transistor $Tr_3$ by limiting the base current thereof, thereby protecting the transistor $Tr_3$ from the overcurrent.

As described above, in the regulator IC 51, when the control voltage $V_C$ is applied to the control terminal $CNT_3$, the transistor $Tr_3$ controls the input voltage $V_{IN}$ and produces the output voltage $V_O$ of a predetermined value. The output voltage $V_O$ is then applied to a load 55. The responsibility of the output voltage $V_O$ is improved by a capacitor $C_4$.

Figure 12:
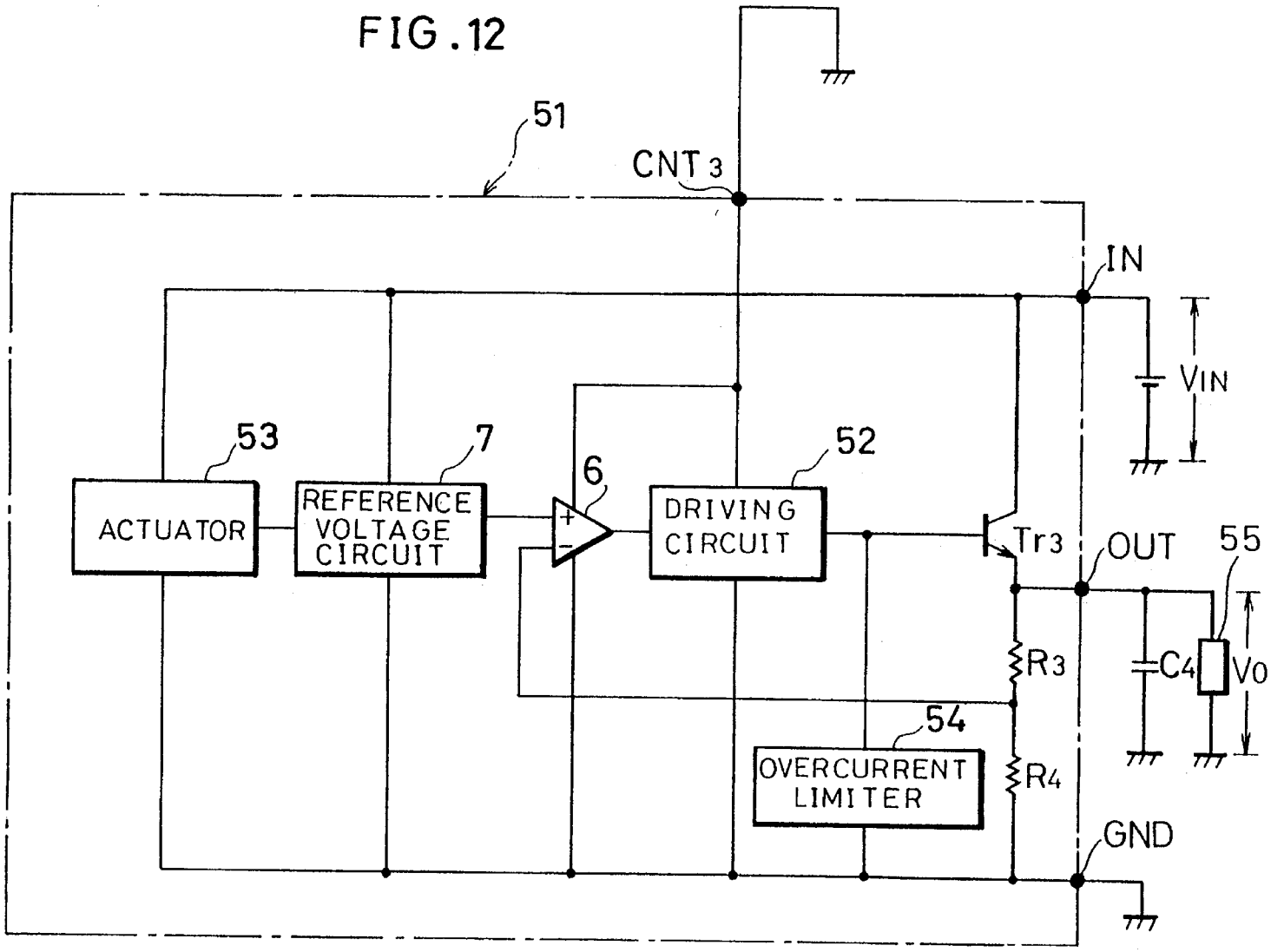
FIG. 12 is a circuit diagram showing switching off the output of the regulator IC of FIG. 10 as an example.

When the control terminal $CNT_3$ is grounded as illustrated in FIG. 12, the output of the regulator IC 51 is switched off. The switching of the output may be performed by means of a transistor as mentioned above.

Figure 13:
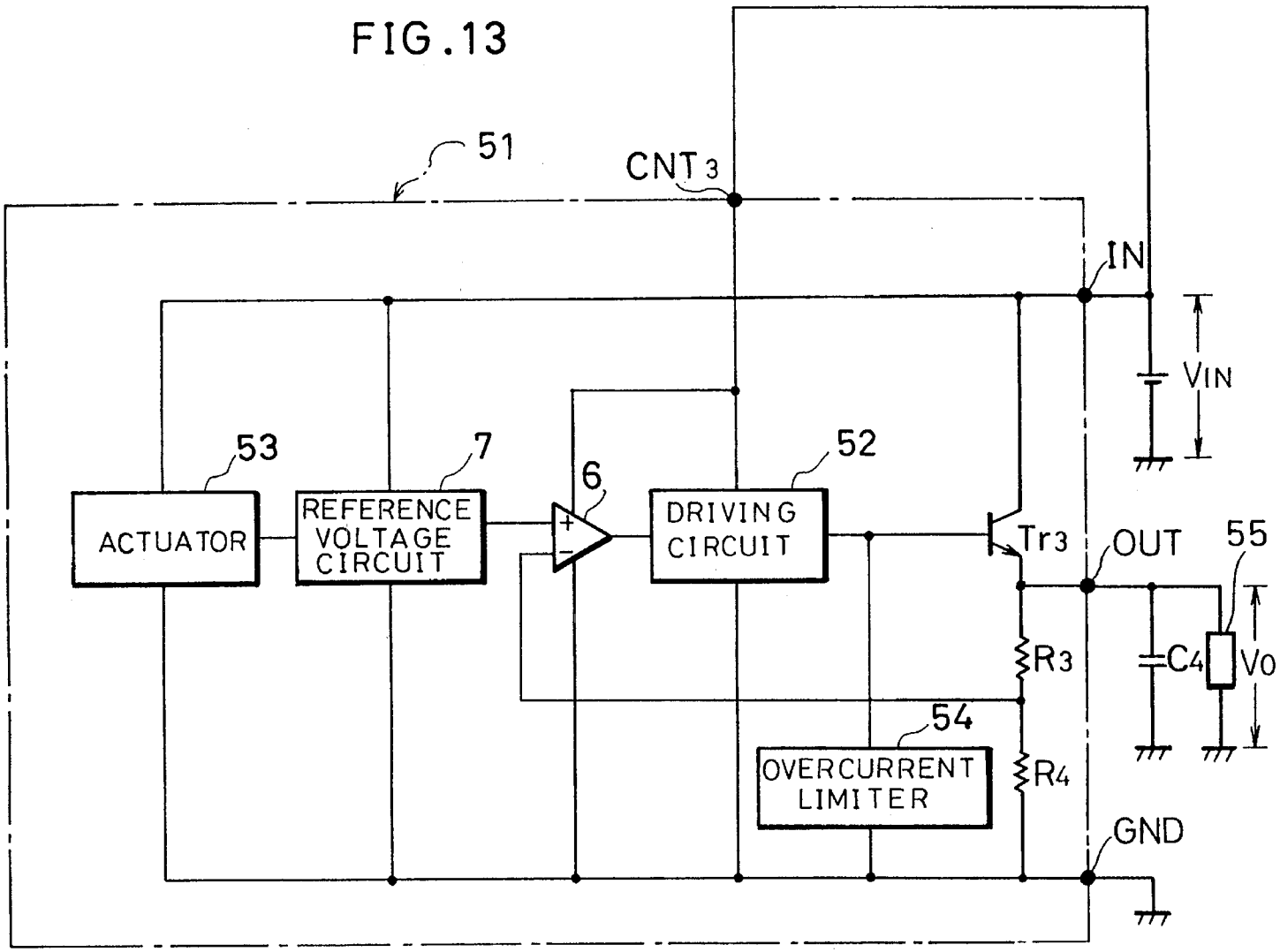
FIG. 13 is a circuit diagram showing the actuation of the regulator IC of FIG. 10 with an input voltage as an example.

In the regulator IC 51, on the other hand, as illustrated in FIG. 13, when the control terminal $CNT_3$ is connected to the input terminal IN, the transistor $Tr_3$ is driven by the input voltage $V_{IN}$. Therefore, the regulator IC 51 functions in the same manner as a conventional regulator IC using an n-p-n transistor. With this structure, the regulator IC 51 is used in a system having a single power source.

Figure 14:
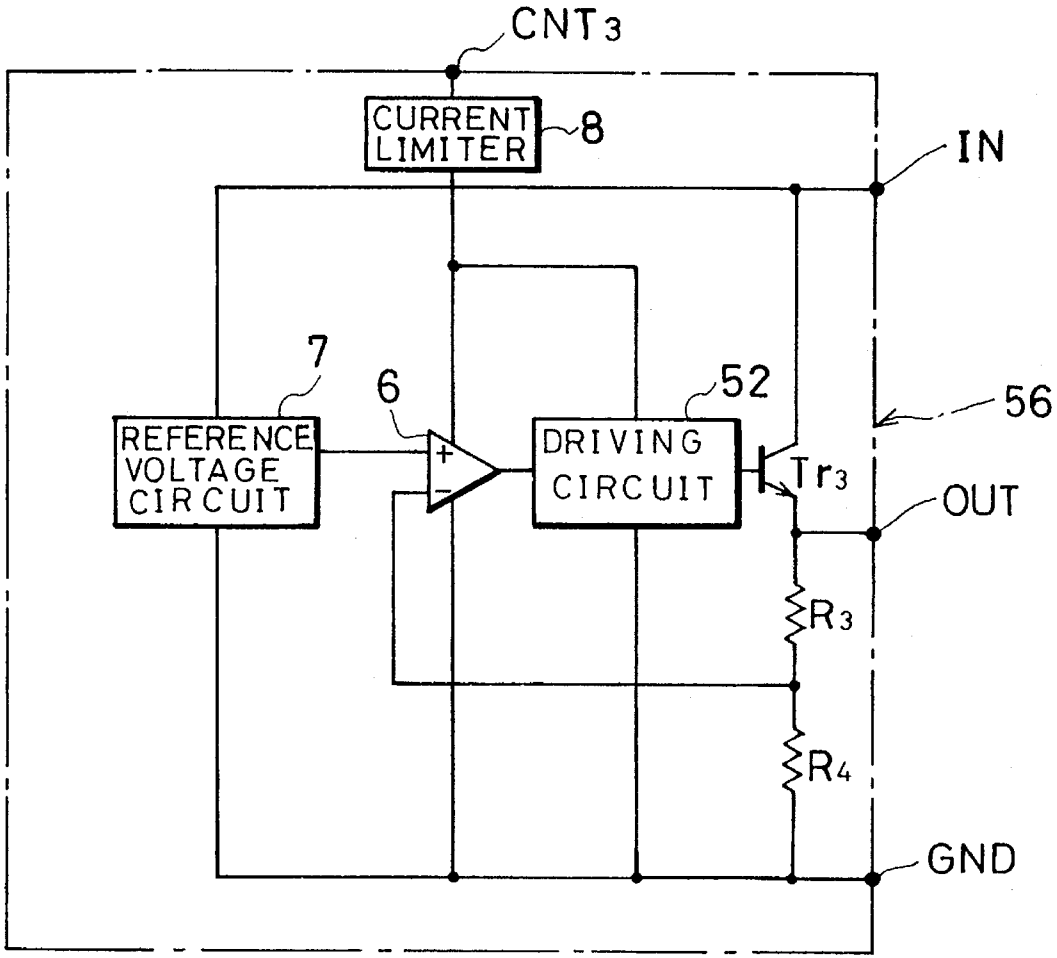
FIG. 14 is a circuit diagram of a modified regulator IC of FIG. 10, wherein a current limiter is placed in a position located between a control terminal and a differential amplifier and between the control terminal and a driving circuit.
Figure 15:
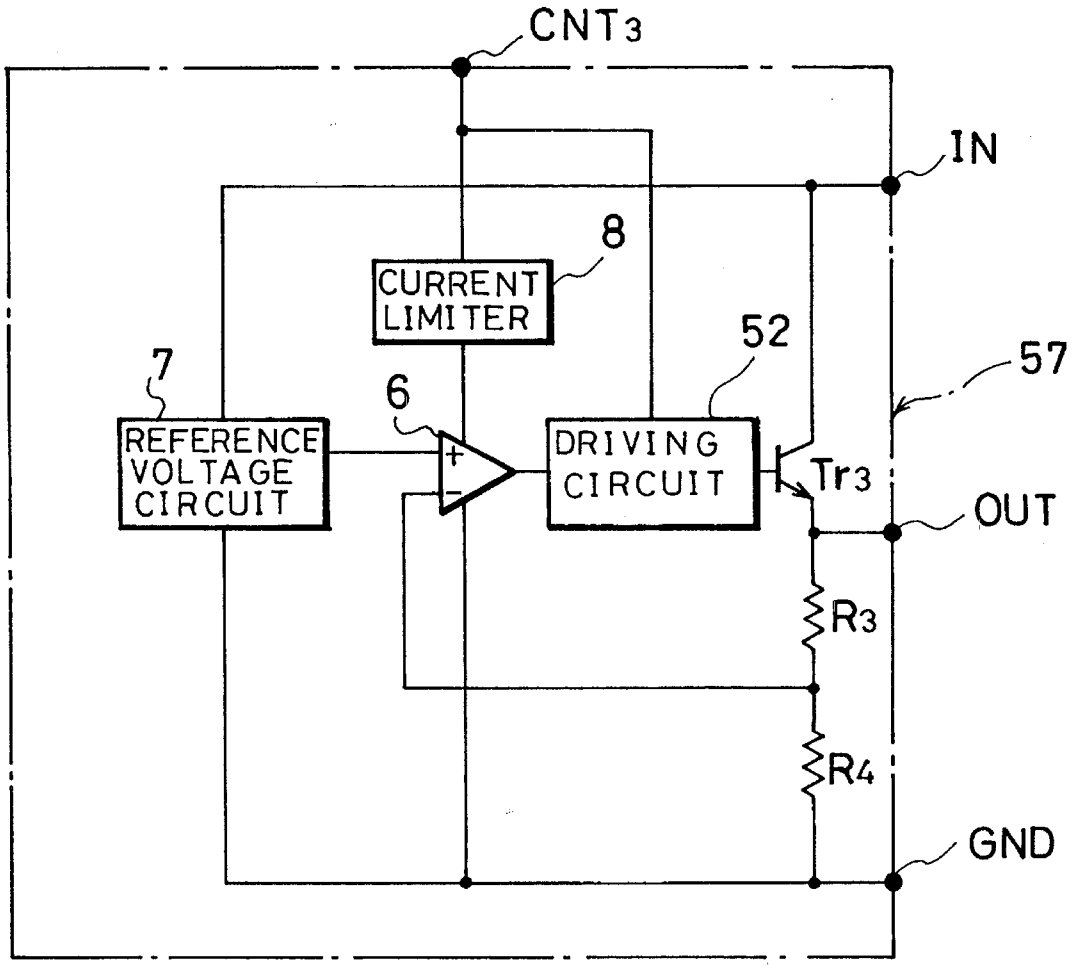
FIG. 15 is a circuit diagram of a modified regulator IC of FIG. 10, wherein a current limiter is placed between a control terminal and a differential amplifier.
Figure 16:
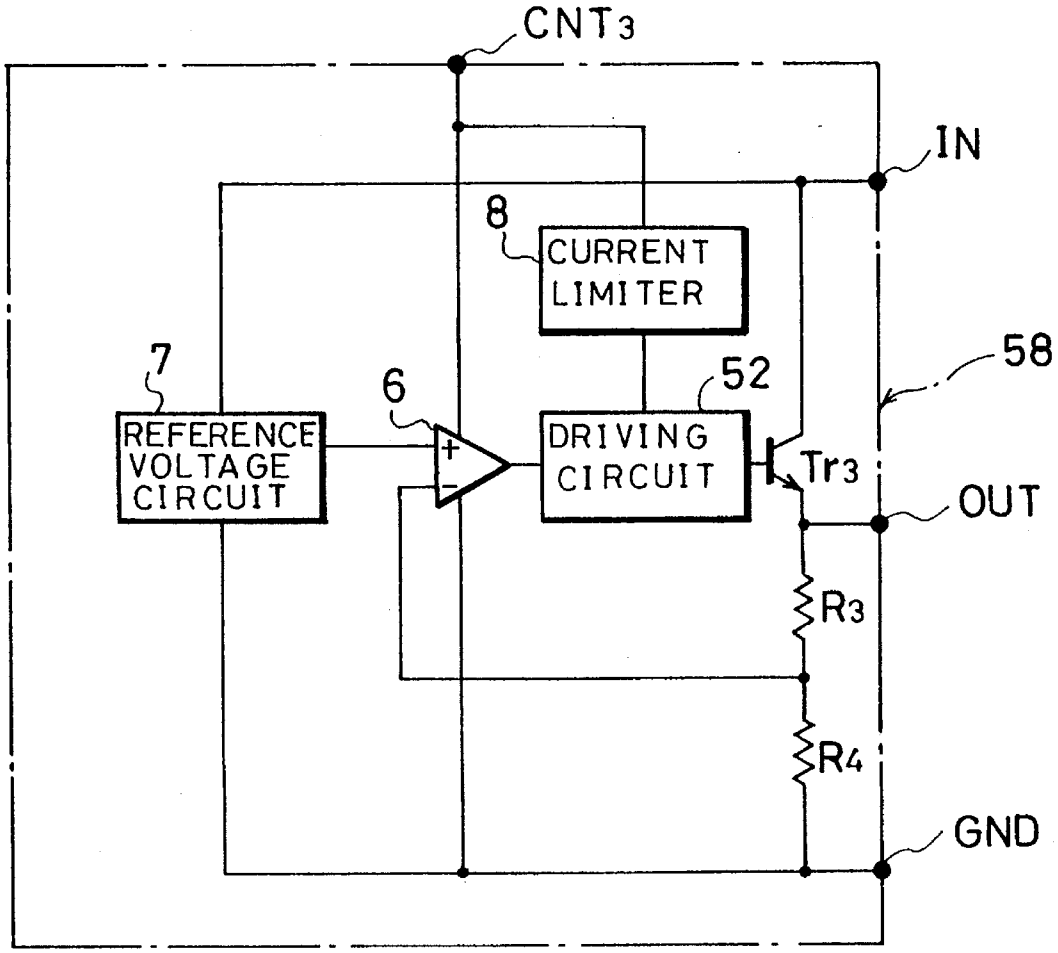
FIG. 16 is a circuit diagram of a modified regulator IC of FIG. 10, wherein a current limiter is placed between a control terminal and a driving circuit.

Modified examples of the regulator IC 51 are shown as regulators IC 56, 57 and 58 in FIGS. 14 through and 16.

In the regulator IC 56, the current limiter 8 is placed in a position which is located between the control terminal $CNT_3$ and the differential amplifier 6 and between the control terminal $CNT_3$ and the driving circuit 52. In the regulator IC 57, the current limiter 8 is placed between the control terminal $CNT_3$ and the differential amplifier 6. In the regulator IC 58, the current limiter 8 is placed between the control terminal $CNT_3$ and the driving circuit 52. By providing the current limiter 8, the current flowing from the control terminal $CNT_3$ to the differential amplifier 6 and to the driving circuit 52 is limited to a predetermined value, thereby restricting an increase in the consumption of power.

[EMBODIMENT 4]

Figure 17:
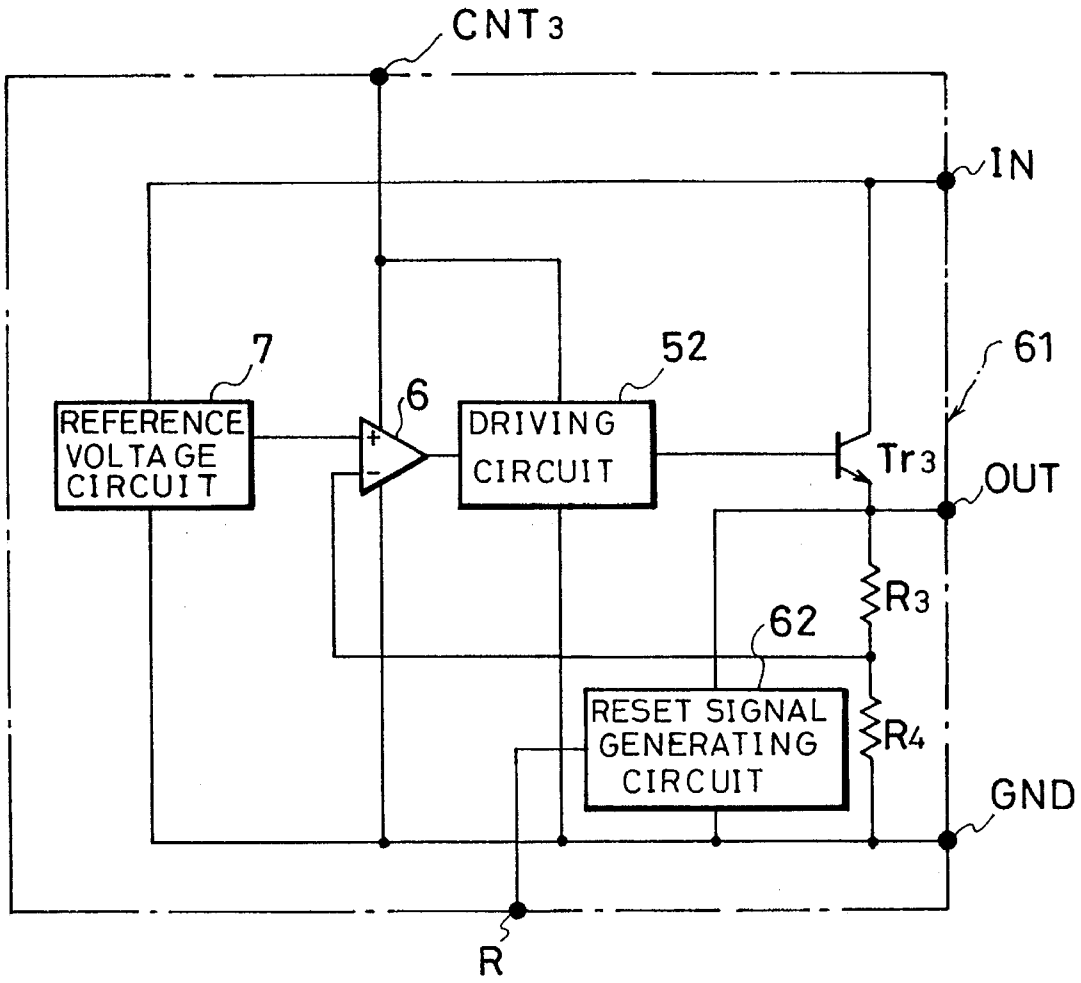
FIG. 17 is a circuit diagram schematically showing a structure of a regulator IC according to a fourth embodiment of the present invention.
Figure 18:
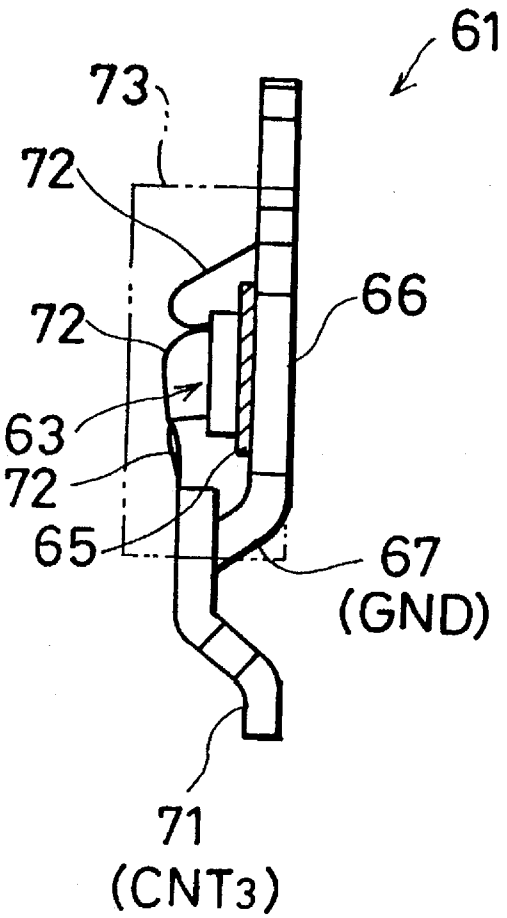
FIG. 18(*a*) is a front view showing an internal structure of the regulator IC of FIG. 17.
Figure 18:
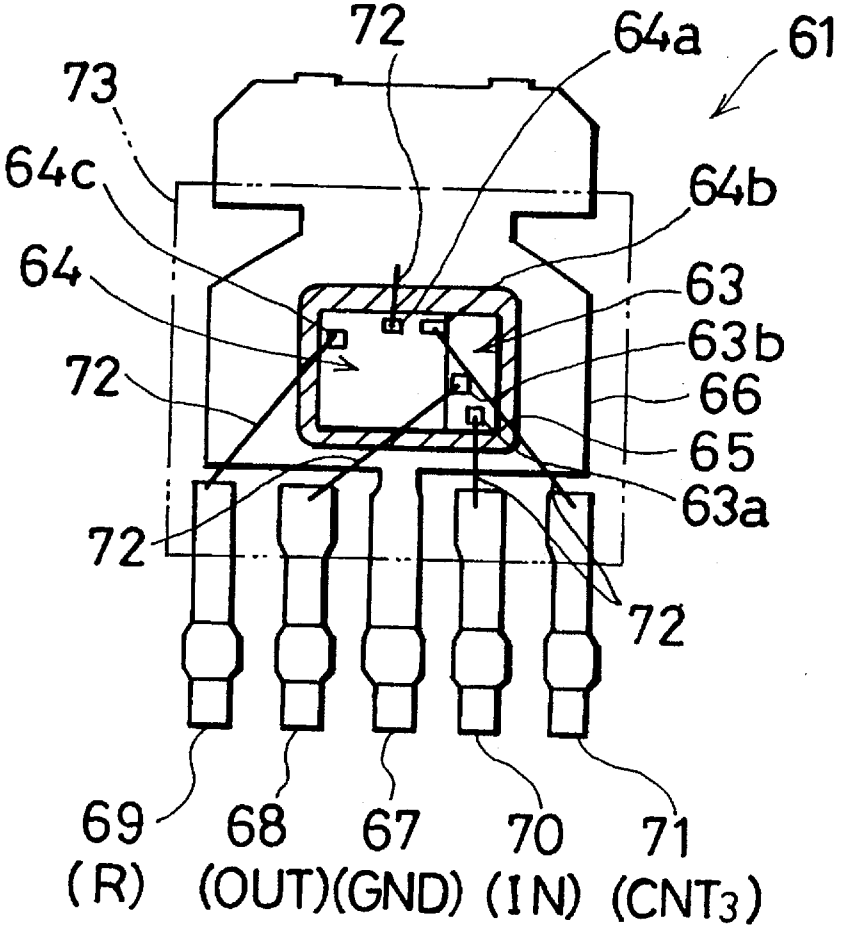
Figure 19:
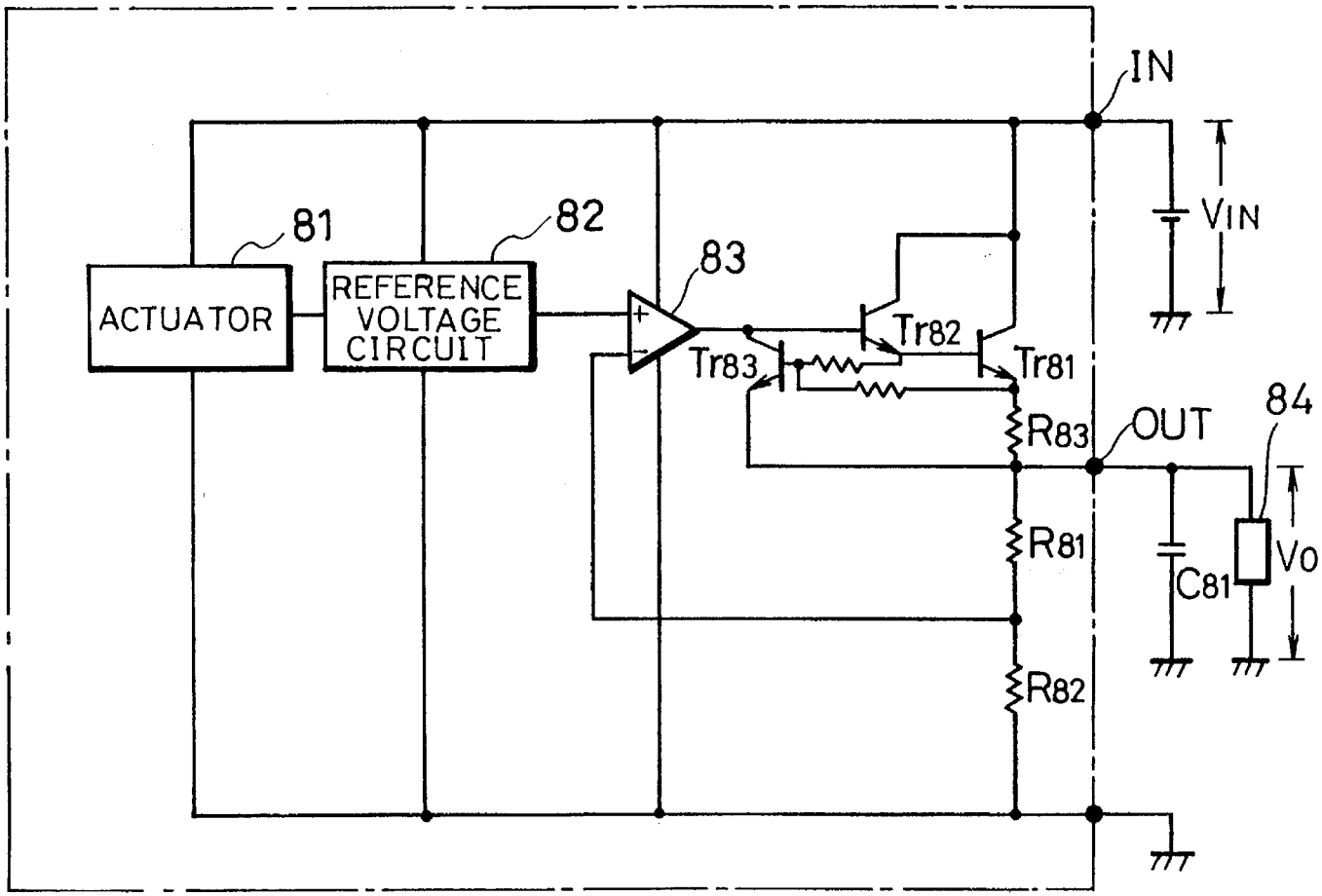
FIG.19 (PRIOR ART)
FIG. 19 is a circuit diagram showing a structure of a conventional direct-current stabilizer using an n-p-n control transistor..
Figure 20:
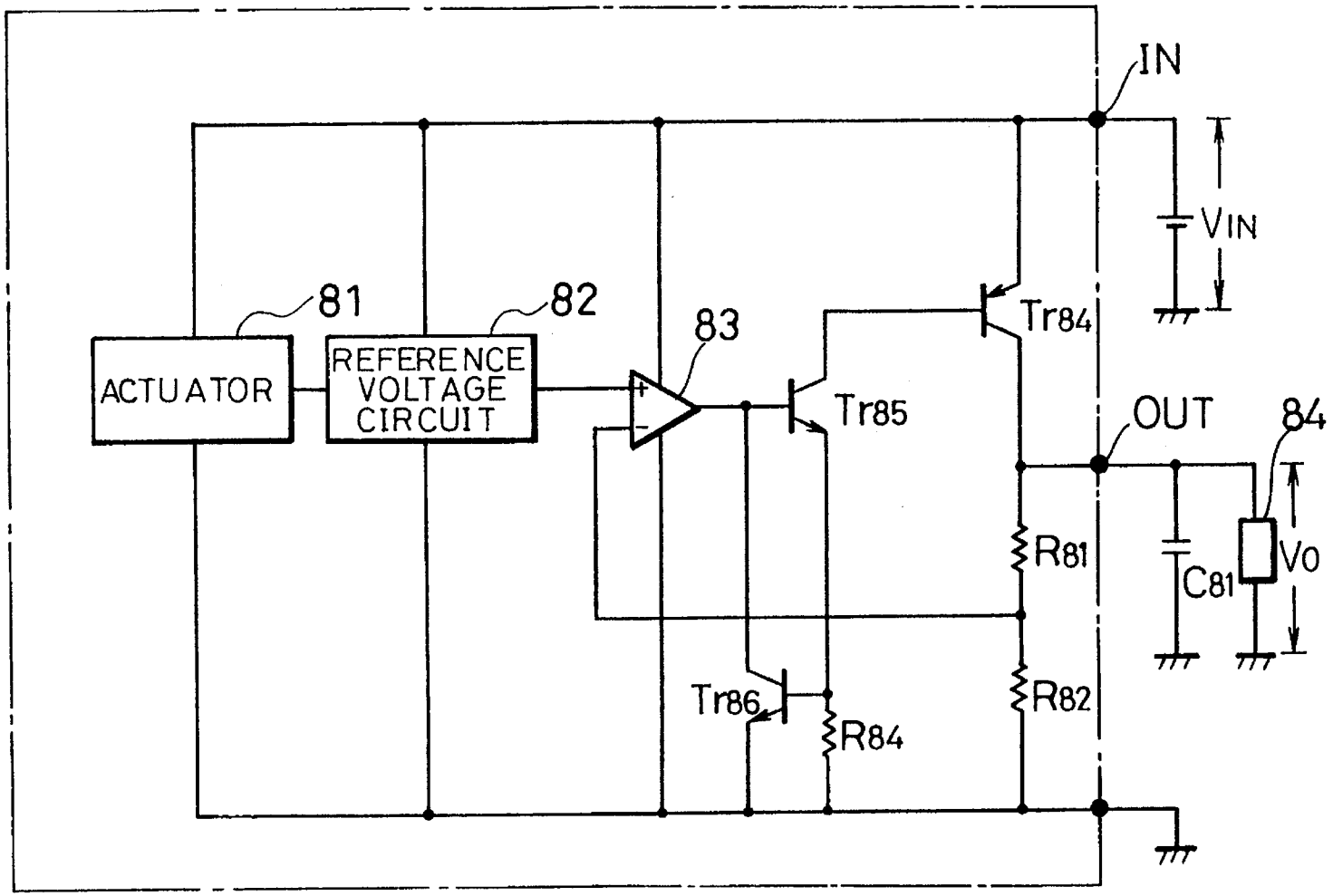
FIG. 20 (PRIOR ART)
FIG. 20 is a circuit diagram showing a structure of a conventional direct-current stabilizer using a p-n-p control transistor.
Figure 21:
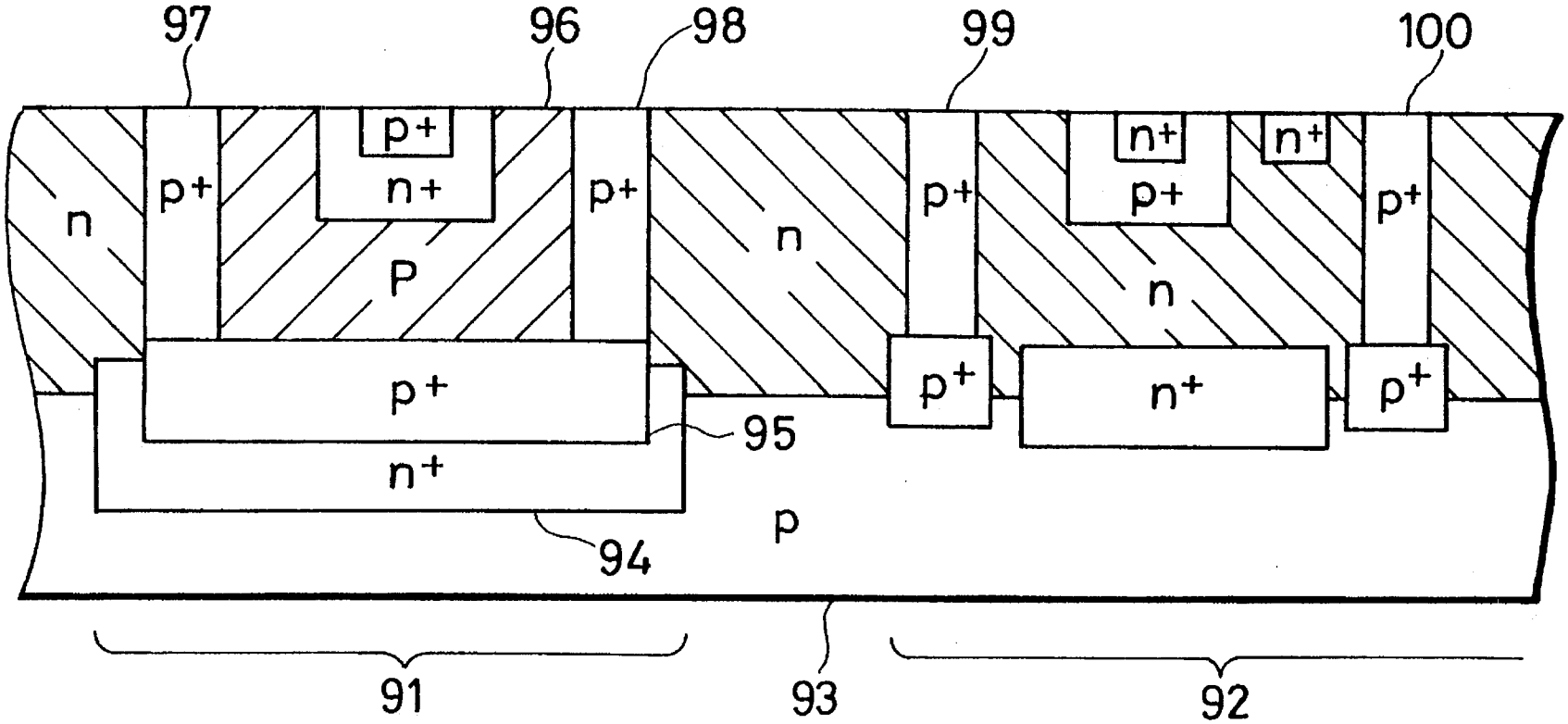
FIG. 21 (PRIOR ART)
FIG. 21 is a vertical section showing a structure of a vertically constructed chip of a conventional direct-current stabilizer using a p-n-p control transistor.
Figure 22:
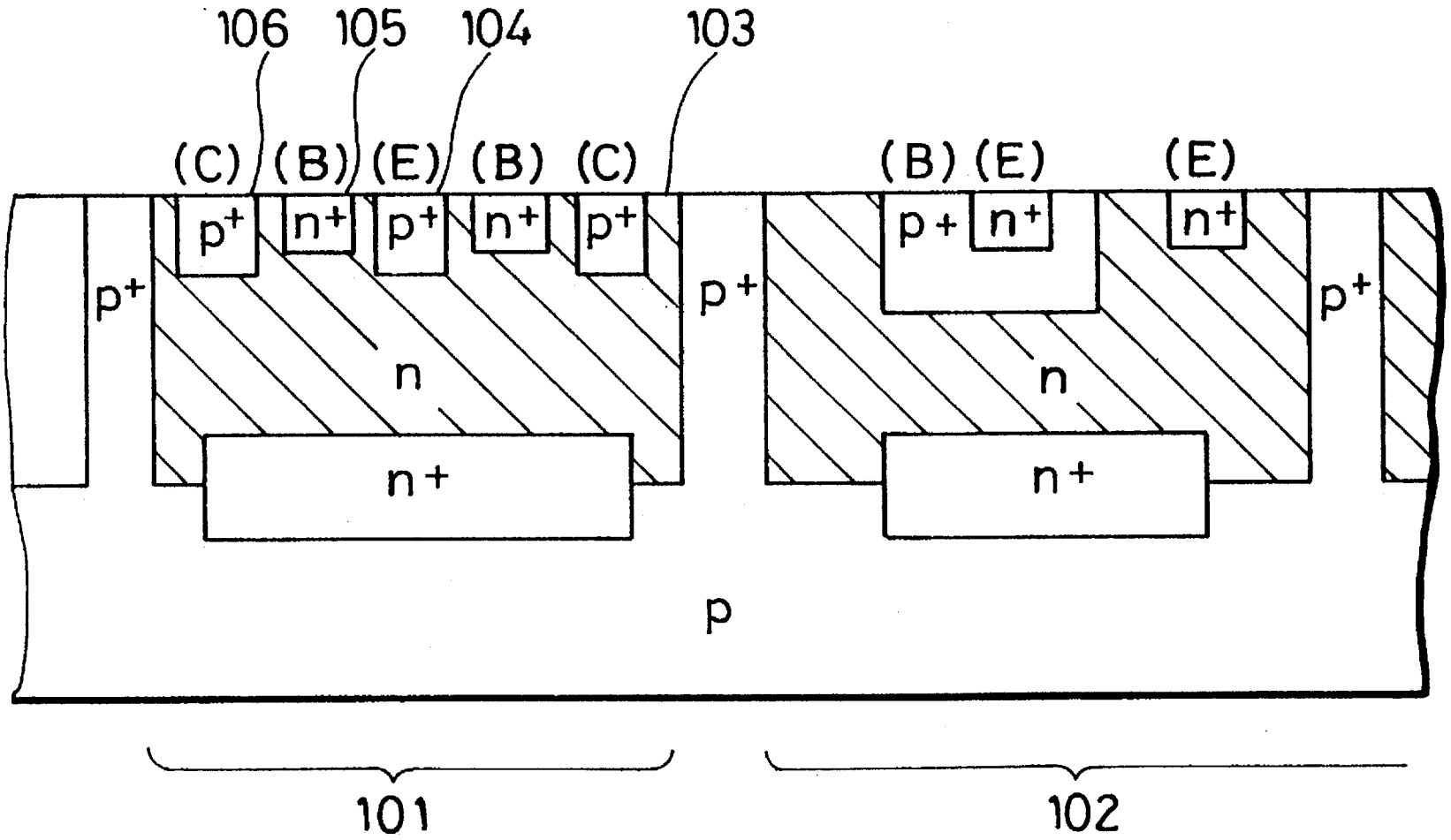
FIG. 22 (PRIOR ART)
FIG. 22 is a vertical section showing a structure of a laterally constructed chip of a conventional direct-current stabilizer using a p-n-p control transistor.

The following description discusses a fourth embodiment of the present invention with reference to FIGS. 17 and 18. The components having the same function as the components described in the first and third embodiments will be designated by the same code and their description will be omitted.

A direct-current stabilizer of this embodiment is a regulator IC 61 shown in FIG. 17. The regulator IC 61 is constructed by adding a reset signal generating circuit 62 to the regulator IC 51 of the third embodiment shown in FIG. 10. The regulator IC 61 is therefore provided with a reset terminal R for outputting a reset signal.

The reset signal generating circuit 62 is connected to the output terminal OUT, and generates a reset signal when it detects an output voltage $V_O$ lower than a predetermined level. The reset signal is supplied to the reset terminal R and then transmitted to essential external devices. For example, in the case where this direct-current stabilizer is used in a power source for a microcomputer, when the output voltage $V_O$ drops, the reset signal prevents a runaway of the microcomputer.

As illustrated in FIGS. 18(*a*) and 18(*b*), the regulator IC 61 includes a transistor section 63 and an IC section 64 formed on a signal chip. The transistor section 63 is the transistor $Tr_3$ in chip form. The IC section 64 is formed by integrating the above-mentioned elements and circuits except for the transistor $Tr_3$ on a single chip. The transistor section 63 and the IC section 64 are fixed onto a metal flame 66 by die bonds at a solder junction 65.

A central portion of one edge of the metal flame 66 is elongated to form an outer lead flame 67 serving as the ground terminal GND. In FIGS. 18(*a*) and 18(*b*), outer lead flames 68 and 69 are formed in parallel with and on the left side of the outer lead flame 67, while outer lead flames 70 and 71 are formed in parallel with and on the right side thereof.

The outer lead flame 68 next to the outer lead flame 67 serves as the output terminal OUT, and the outer lead flame 69 next to the outer lead flame 68 serves as the reset terminal R. The outer lead flame 70 next to the outer lead flame 67 serves as the input terminal IN, and the outer lead flame 71 next to the outer lead flame 70 is the control terminal CNT3.

In the transistor section 63, a contact section 63*a* as the collector is connected to the outer lead flame 70, while a contact section 63*b* as an emitter is connected to the outer lead flame 68. In the IC section 64, a contact section 64*b* to be grounded is connected to the metal flame 66, a contact section 64*b* to which a control signal is input is connected to the outer lead flame 71, and a contact section 64*c* for outputting a reset signal is connected to the outer lead flame 69. These connections are made by wire bonds using metal wires 72.

Portions of the metal flame 66 on which the transistor section 63 and the IC section 64 are mounted and one end of each of the outer lead flames 67 through 71 are covered with a package 73. The package 73 is made from a coating resin, such as an epoxy resin, and formed by transfer-molding for example.

Similar to the regulator IC 51 of the third embodiment, in the regulator IC 61 having the above-mentioned structure, since the control voltage $V_C$ having a value different from that of the input voltage $V_{IN}$ is used as a power source for the driving circuit 52, the low-cost regulator IC 61 having reduced losses is obtained. Moreover, since the regulator IC 61 generates the reset signal, it is applicable to microcomputer applied systems.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An integrated direct-current stabilizer comprising:

an input terminal for receiving an input voltage;

an output terminal whereat a stabilized output voltage is provided;

an n-p-n control transistor having a collector connected to the input terminal and an emitter coupled to a common ground and said output terminal, the control transistor controlling said output voltage of said direct-current stabilizer at a predetermined value by reducing the input voltage;

a differential amplifier formed as an integrated circuit with the control transistor for controlling a base current of said control transistor in accordance with said output voltage and a reference voltage at its input so that said control transistor controls said output voltage at said predetermined value;

a control terminal, provided separately from said input terminal, for supplying to said differential amplifier a source voltage, said differential amplifier, in response to the source voltage, applying to a base of said control transistor a control voltage which is greater than or equal to a sum of an emitter voltage and a base-emitter voltage;

a further n-p-n transistor having a collector connected to said control terminal, a base connected to an output of the differential amplifier, and an emitter connected to the base of said control transistor, said further n-p-n transistor and said control transistor being a Darlington pair; and wherein a withstanding voltage of said control terminal is higher than a withstanding voltage of said input terminal, and wherein the input terminal and said source voltage applied to the control terminal are input to the common ground.

2. An integrated direct-current stabilizer comprising:

an input terminal for receiving an input voltage;

an output terminal whereat a stabilized output voltage is provided;

an n-p-n control transistor having a collector connected to the input terminal and an emitter coupled to a common ground and said output terminal, the control transistor controlling said output voltage of said direct-current stabilizer at a predetermined value by reducing the input voltage;

a differential amplifier formed as an integrated circuit with the control transistor for controlling a base current of said control transistor in accordance with said output voltage and a reference voltage at its input so that said control transistor controls said output voltage at said predetermined value;

a control terminal, provided separately from said input terminal, for supplying to said differential amplifier a source voltage, said differential amplifier, in response to the source voltage, applying to a base of said control transistor a control voltage which is greater than or equal to a sum of an emitter voltage and a base-emitter voltage;

a p-n-p transistor having an emitter connected to said control terminal, a base connected to an output of the differential amplifier, and a collector connected to the base of said control transistor, said p-n-p transistor and said control transistor being a Darlington pair; and wherein a withstanding voltage of said control terminal is higher than a withstanding voltage of said input terminal, and wherein the input terminal and said source voltage applied to the control terminal are input to the common ground.

* * * * *